US006388619B2

(12) United States Patent
Perrott et al.

(10) Patent No.: US 6,388,619 B2
(45) **Date of Patent: *May 14, 2002**

(54) DUAL BAND ANTENNA

(75) Inventors: Roger Adrian Perrott; Martin Stevens Smith, both of Chelmsford; Sonya V Amos, Ongar, all of (GB)

(73) Assignee: Nortel Networks Limited, St. Laurent (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/431,815

(22) Filed: Nov. 2, 1999

(51) Int. Cl.[7] ..... H01Q 1/38

(52) U.S. Cl. ..... 343/700 MS; 343/725; 343/767; 343/770

(58) Field of Search ..... 343/700 MS, 725, 343/729, 767, 770, 771, 786, 846

(56) References Cited

U.S. PATENT DOCUMENTS

| | | | | |
|---|---|---|---|---|
| 4,141,012 A | | 2/1979 | Hockham et al. | 343/729 |
| 4,740,795 A | | 4/1988 | Seavey | 343/786 |
| 4,772,890 A | * | 9/1988 | Bowen et al. | 343/700 MS |
| 5,160,936 A | * | 11/1992 | Braun et al. | 343/725 |
| 5,534,877 A | * | 7/1996 | Sorbello et al. | 343/700 MS |
| 6,175,333 B1 | * | 1/2001 | Smith et al. | 343/700 MS |

FOREIGN PATENT DOCUMENTS

| | | |
|---|---|---|
| EP | 0463649 A1 | 1/1992 |
| GB | 2241832 B | 9/1991 |

* cited by examiner

*Primary Examiner*—Don Wong
*Assistant Examiner*—Shih-Chao Chen
(74) *Attorney, Agent, or Firm*—Lee, Mann, Smith, McWilliams, Sweeney & Ohlson

(57) ABSTRACT

A flat-plate dual band array antenna is described which comprises two flat plate arrays of single band antenna elements, each of which operates in a different frequency band. The two flat plate arrays are positioned one above the other, with areas in the upper flat plate array being removed in order that the antenna elements in the lower flat plate array can radiate through the upper flat plate array. The geometric arrangement of the antenna elements is such that distribution networks for the antenna elements can be accommodated in the limited space available. Dual band flat-plate array feeds for a reflector antenna are also described. These use at least two flat-plate arrays that are positioned one above the other. Again regions in the upper flat-plate array are removed to allow the lower flat-plate to operate through the upper one. The geometric arrangement of the antenna elements in these array feeds is such that transmit and receive beams are provided that have co-incident phase centers and approximately equal beam-widths. The flat plate array antenna and reflector antennas described are particularly useful for subscriber satellite communication systems such as satellite TV, with receive signals being in the Ku band and transmit signals being in the Ka band.

15 Claims, 19 Drawing Sheets x = 3mm , y = 1mm

DUAL BAND ANTENNA

BACKGROUND OF THE INVENTION

The invention relates to dual band antennas including but not limited to dual band flat plate array antennas and dual band array feeds for reflector antennas.

Domestic satellite communication antennas are widely used to receive signals such as television broadcasts rather than to transmit as well as receive. However, demand for interactive services such as interactive television and use by small office/home office users has led to the requirement for domestic two-way satellite communication to be provided.

This is possible by using two antennas, one for an up-link or transmission signal and one for a down-link or reception signal. However, this increases the cost of the equipment needed by a subscriber and also increases installation, transport and maintenance costs. The space required for the antennas is also greater and this is a particular problem for domestic applications where space is at a premium.

The up-link and down-link signals are provided at different frequency bands in order that they are readily distinguishable and do not interfere. Antennas which provide two frequency bands are referred to as dual band antennas and a number of different types of dual band antennas are known. However, these suffer from a number of drawbacks when considering subscriber satellite communication systems.

For example, frequency selective surfaces can be used to provide dual bands as in earth station antennas. FIG. 1 is a schematic diagram showing use of a frequency selective surface 133. Signals from a transmitter 131 reflect from the frequency selective surface 133 and onto a reflector 130. However, signals received at a different frequency and reflected from reflector 130 towards the frequency selective surface pass through that surface 131 towards a receiver 132. That is, the frequency selective surface is arranged to reflect signals of a certain frequency range and transmit others. In this way dual band communication using only one main reflector 130 is possible. However, this type of system is difficult and expensive to install because four components, the transmitter 131, receiver 132, frequency selective surface 133 and reflector 130, must all be correctly aligned. This is difficult to achieve at low cost. Another problem is that cabling must be provided to the transmitter and receiver separately because these have different locations. This also increases installation costs.

Another approach has been to provide a dual band feed for a reflector antenna. For example, this type of system is described in U.S. Pat. No. 4,740,795, Seavey. Two coaxial waveguides are used for the respective two frequency bands and in order that the beamwidth of each beam is similar (and arranged to cover the reflector surface) these waveguides are of different diameter. In order to accommodate this arrangement the design is complex and expensive. In addition, dual band feed systems such as that described in Seavey are not suitable for monopulse alignment methods or for distributed power amplification.

Monopulse alignment methods enable an antenna to be accurately aligned with respect to a satellite and this is particularly important in subscriber satellite communication applications where there is typically little room for alignment error and where costs for an operator to align an antenna are high. Distributed power amplification is advantageous because high power transmit amplifiers are not readily available at millimetric frequencies. In dual band feed systems such as the Seavey system, distributed power amplification is not possible because there is only one transmit antenna element.

U.S. Pat. No. 4,141,012, Hockham et al. describes a dual band waveguide radiating element for an antenna. Using this element an array antenna which operates at two frequencies can be provided. The waveguide element is excited by probe structures entering the guide perpendicular to the plane of the array face. This has significant cost and size implications because the antenna is not a "flat-plate". Also, in terms of the number of elements being fed the approach described in U.S. Pat. No. 4,141,012 is inefficient.

A general rule in antenna design is that, in order to "focus" the available energy to be transmitted into a narrow beam, a relatively large "aperture" is necessary. The aperture may be provided by a broadside array, a longitudinal array, an actual radiating aperture such as a horn, or by a reflector antenna which, in a receive mode, receives a collimated beam of energy and focuses the energy into a converging beam directed toward a feed antenna, or which, in a transmit mode, focuses the diverging energy from a feed antenna into a collimated beam.

Those skilled in the art know that antennas are reciprocal devices, in which the transmitting and receiving characteristics are equivalent. Generally, antenna operation is referred to in terms of either transmission or reception, with the other mode being understood therefrom.

A particular problem with respect to feeds for reflector antennas is that manufacturing costs are relatively high because many parts are required and the overall structure is complex. For example, the structure described in U.S. Pat. No. 4,740,795, Seavey, above is particularly complex and expensive. Often special connectors are required and complex shielding is necessary to prevent leak of electromagnetic radiation. Also, because many different parts are used, each of these has to be tested individually which increases manufacturing time and makes maintenance and repair difficult. These factors increase the cost of feeds which is particularly disadvantageous for domestic systems intended for mass production.

It is accordingly an object of the present invention to provide a dual band antenna which overcomes or at least mitigates one or more of the problems noted above.

Further benefits and advantages of the invention will become apparent from a consideration of the following detailed description given with reference to the accompanying drawings, which specify and show preferred embodiments of the invention.

SUMMARY OF THE INVENTION

According to a first aspect of the present invention there is provided a dual band flat plate antenna comprising:

(i) a first flat plate array of first single band antenna elements operable at a first frequency band;

(ii) a second flat plate array of second single band antenna elements operable at a second frequency band different from the first frequency band, said second flat play array being positioned over said first flat plate array such that said second single band antenna elements overlie regions of said first flat plate array between said first single band antenna elements; and wherein (iii) one or more regions in said second flat plate array are removed such that in use, said first single band antenna elements are operable through said second flat plate array.

This has the advantage that a compact, low cost antenna array is provided that operates at two frequency bands and which has a flat-plate form. The flat-plate form enables the antenna to be easily installed and for electronics associated with the antenna to be mounted on the back of the flat-plate.

According to a second aspect of the present invention there is provided a dual band flat-plate array feed for a reflector antenna said array feed comprising:

(i) a first flat plate array of first single band antenna elements arranged to operate at a first frequency band;

(ii) a second flat plate array of second single band antenna elements arranged to operate at a second frequency band, said second flat play array being positioned over said first flat plate array such that said second single band antenna elements overlie regions of said first flat plate array between said first single band antenna elements; and wherein (iii) one or more regions in said second flat plate array are removed such that in use, said first single band antenna elements are operable through said second flat plate array.

This has the advantage that by superimposing the first and second flat plate arrays a compact and low cost feed is provided that operates at two frequency bands. Monopulse alignment methods can be used to correctly align the antenna during installation and this reduces installation costs. Also, distributed power amplification can be used. In this way a low cost, dual band, compact, array feed is formed for a reflector antenna.

According to another aspect of the present invention there is provided a reflector antenna comprising a dual band flat-plate array feed said flat-plate array feed comprising:

(i) a first flat plate array of first single band antenna elements arranged to operate at a first frequency band;

(ii) a second flat plate array of second single band antenna elements arranged to operate at a second frequency band, said second flat play array being positioned over said first flat plate array such that said second single band antenna elements overlie regions of said first flat plate array between said first single band antenna elements; and wherein (iii) one or more regions in said second flat plate array are removed such that in use, said first single band antenna elements are operable through said second flat plate array.

In this way a low cost, dual band, compact, reflector antenna is formed that can be used for subscriber satellite communication systems such as satellite television.

The present invention also encompasses a method of operating a dual band flat plate array antenna as described above said method comprising the steps of:

(i) transmitting information input by a user to a satellite using said second single band antenna elements; and (ii) receiving signals from said satellite using said first single band antenna elements, on the basis of said transmitted information.

This provides the advantage that using the dual band flat plate array antenna a user is able to communicate with a satellite, for example, in a satellite television system. The user is then able to access communications systems to which the satellite is linked, such as the internet.

The present invention also provides a method of operating a reflector antenna as described above said method comprising the steps of:

(i) transmitting information input by a user to a satellite using said second single band antenna elements; and (ii) receiving signals from said satellite using said first single band antenna elements, on the basis of said transmitted information.

DETAILED DESCRIPTION OF THE EMBODIMENTS

Embodiments of the present invention are described below by way of example only. These examples represent the best ways of putting the invention into practice that are currently known to the Applicant although they are not the only ways in which this could be achieved.

Pending U.S. patent application Ser. No. 09/339,604, also assigned to Nortel Networks Corporation, describes a dual band flat-plate array antenna for use in a subscriber satellite communication system and the contents of U.S. Pat. No. 09/339,604 are incorporated herein by reference. Whilst the antennas and feeds described in U.S. Pat. No. 09/339,604 are effective and useful, the present application advantageously extends the dual band antenna systems of U.S. Pat. No. 09/339,604 for use under certain circumstances.

Figure 1:
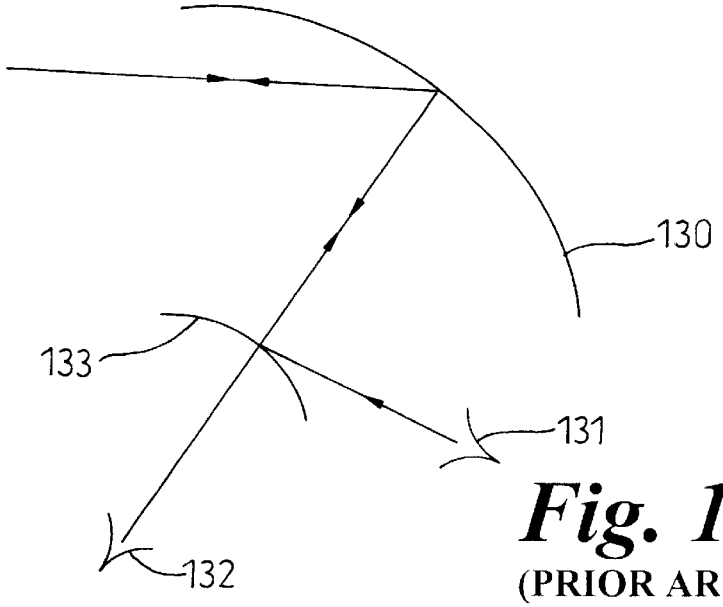
Fig. 1 (PRIOR ART)
FIG. 1 illustrates use of a frequency selective surface in a dual band reflector antenna according to the prior art.
Figure 2:
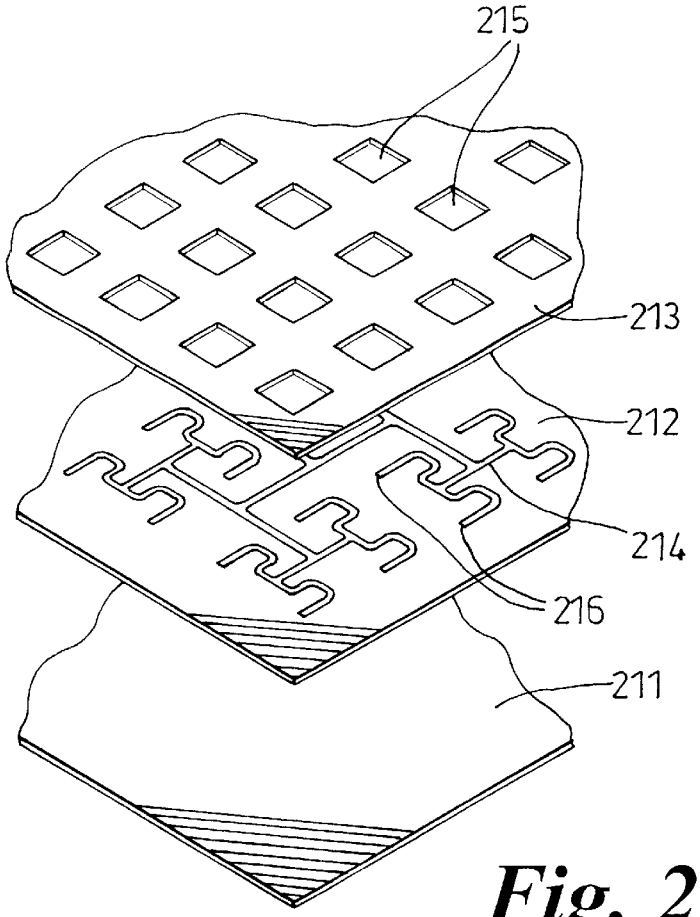
Fig. 2 (PRIOR ART)
FIG. 2 is an exploded view of a flat-plate antenna array according to the prior art.

FIG. 2 illustrates the structure of a flat-plate array antenna according to the prior art. A back-plate 211 is provided which is made from aluminium or other electrically conducting material. Above the back-plate 211 a power supply circuit plate 212 is placed. This power supply circuit plate 212 is formed from plastics material or other electrically insulating material. On the power supply circuit plate 212 a power supply circuit pattern, or distribution network, 214 of conducting strips is formed for connection to means for controlling the antenna. This pattern 214 forms a type of "tree" structure with many terminations 216. Each termination 216 is called a "probe" and the probes are arranged in an array. Above the power supply circuit plate 212 a radiation plate 213 or top plate is provided. This is formed from electrically conducting material such as aluminium and contains a plurality of apertures 215 arranged in an array. The array of apertures 215 corresponds to the array of probes in the power supply circuit plate 212 so that when the radiation plate 213 is placed over the power supply circuit plate 212 each probe projects into a region below an aperture 215. Each probe and aperture combination then forms an antenna element which enables radiation such as signals (of a certain frequency band) from a satellite to be received. That is, this type of flat-plate array only operates for one frequency band according to the size of the apertures 215 in the radiation plate 213 and the size of the spaces between these apertures. The back plate 211, power supply circuit plate 212 and radiation plate 213 are typically spaced apart using plastic foam inserts (not shown). Downstream of the flat-plate antenna there is connected an electronic device, particularly a converter, which processes the signals according to the particular application. Coupling of the flat-plate antenna and the electronic processor device is in most cases by means of a hollow waveguide with capacitive coupling-in of the radiation summation signal.

The present invention provides a flat-plate antenna array which operates at two frequency bands. For example, a particular embodiment provides a flat-plate antenna for Ka—Ku band satellite communication access units where the transmit (Tx) band is about 29.5 to 30 GHz (Ka band) and the receive (Rx) band is about 10.7 to 12.75 GHz (Ku band).

In the antenna described in U.S. Pat. No. 09/339,604, two superimposed layers of probes and apertures are provided in order to enable a flat-plate antenna to operate at two frequency bands. The apertures in the different layers are effectively superimposed, aligned or positioned in register. However, to form a flat-plate antenna operating with a transmit frequency of 30 GHz and a receive frequency of 12 GHz it is difficult to arrange the required apertures such that they can be superimposed effectively. Also, each layer of probes requires its own distribution network or power supply circuit pattern 214 and this creates a problem because there is limited space. That is, only the probes 216 of the distribution networks should be exposed beneath an aperture 215 and the rest of the distribution network must be contained within the space between the apertures 215. However, before now this has proved difficult to achieve especially because the spacing between the apertures is required to be less than 1 wavelength in order that grating lobes are not created. As well as this the apertures 215 themselves are preferably about ½ a wavelength in diameter for efficient operation of the antenna.

In the present application, rather than creating dual band antenna elements by superimposing pairs of probes and apertures as in U.S. Pat. No. 09/339,604, two separate sets of single band antenna elements are used. One set of single band antenna elements operates at a transmit frequency band and the other set at a receive frequency band. Each set of single band antenna elements is arranged in a flat plate array structure and the two flat plate arrays are superimposed. However, the antenna elements are positioned within the flat late arrays such that each antenna element in one flat plate array does not overlie any antenna elements in the lower flat plate array. Then, by removing regions of the upper flat plate array, the antenna elements in the lower flat plate array are able to operate through the upper flat plate array. For example, this can be achieved by making an aperture in the upper flat plate array above each antenna element in the lower flat plate array. Alternatively, regions of the upper flat plate array above antenna elements in the lower flat plate array are cut away.

Because two flat plate arrays are used, two distribution networks are required and both of these must be arranged such that they are confined to areas in-between any apertures in the flat plate arrays. Because more apertures are required to allow the lower flat plate to operate, this restricts the area available for the distribution networks.

In a preferred embodiment, the receive antenna elements are provided with two polarities, such as horizontal and vertically polarised elements, whereas the transmit antenna elements are provided at one polarity such as vertically polarised elements. In this case, three flat plate arrays of elements are provided, one for horizontally polarised receive elements, one for vertically polarised receive elements and one for vertically polarised transmit elements. The three flat plate arrays are superimposed and apertures are formed in the upper flat plate arrays to allow the lower flat plate arrays to operate through the upper layers. It is also possible to use four or more flat plate arrays, following the same principles. However, the number of flat plate arrays that can practically be accommodated is eventually limited by the requirements for the distribution networks and positioning of the antenna elements so that they do not overlie one another.

A dual band array feed for a reflector antenna is also provided using two superimposed arrays of antenna elements operating at different frequency bands, and with apertures (or removed regions) in the upper array allowing elements in the lower array to operate. In this case, the antenna elements must also be arranged such that the transmit and receive antenna beams are of approximately equal beamwidths and have approximately equal phase centers.

In all the embodiments involving feeds for reflector antennas described herein, the dual band feed is arranged to provide a transmit and a receive antenna beam with approximately equal beamwidths and approximately equal phase centers. These beamwidths are arranged such that the surface area of the reflector is effectively covered by each beam whilst at the same time minimising regions of the beam that do not fall onto the reflector in order to prevent loss of energy. It is not essential for the beamwidths to be exactly equal as long as they are arranged such the feed operates practically and effectively. Similarly, the phase centers of the beams do not have to be exactly equal as long as the feed is able to operate practically and effectively.

Figure 3:
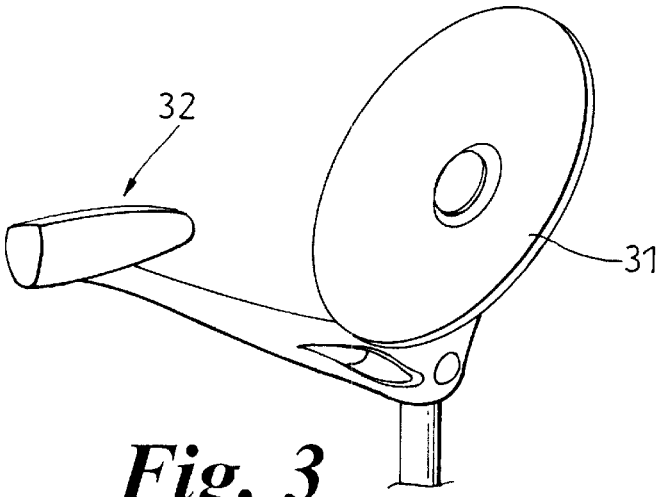
FIG. 3 is a perspective view of a subscriber satellite antenna with a reflector and feed.

Referring now to the figures, FIG. 3 shows a reflector antenna with a reflector 31 and an offset feed unit 32. The offset feed unit 32 incorporates a dual band feed as described herein and any suitable antenna dish 31 may be used. The antenna dish has a diameter of about 75 cm in a preferred embodiment and the offset feed unit 32 is preferably a single enclosure containing the feed and its required electronics.

Figure 4:
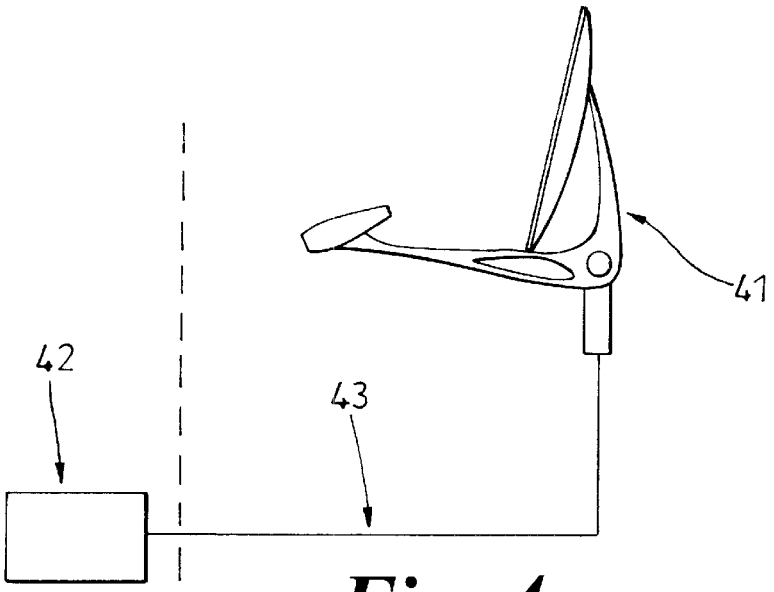
FIG. 4 is a schematic diagram of a satellite interface terminal.

FIG. 4 shows an out door unit (ODU) 41 suitable for use at a domestic location to provide an interface to a satellite communication system. In this example, the ODU comprises a reflector antenna, although any suitable type of antenna may be used. An indoor unit 42 is provided that is connected to the ODU via an interface link IFL 43. For example, the indoor unit may be a set-top box suitable for use with a television in the subscriber's home. By using this interface the subscriber is able to access any communications systems to which the satellite communication system is linked. For example, the internet.

Figure 5:
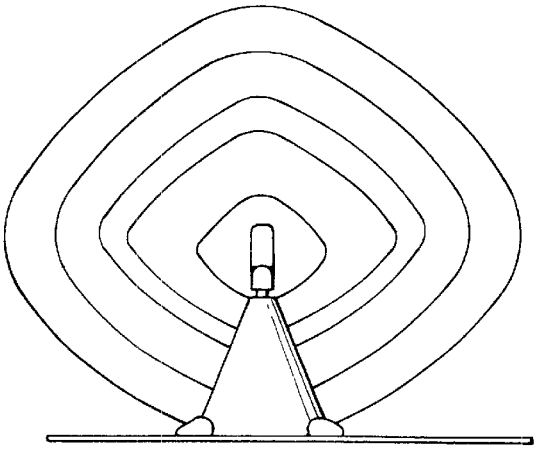
FIG. 5 is a back view of a flat plate antenna mounted on a support.
Figure 6:
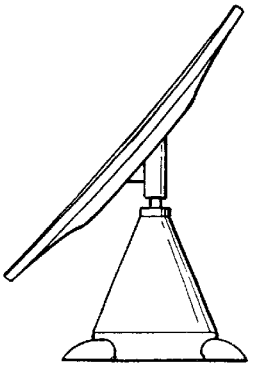
FIG. 6 is a side view of the flat plate antenna of FIG. 5.

FIGS. 5 and 6 show a flat plate antenna mounted on a support. The flat plate antenna may form the ODU of FIG. 4 instead of the reflector antenna of FIG. 3. Flat plate antennas may be housed with their required electronics in one enclosure and this gives the advantage of being aesthetically acceptable and resistant to wind.

Figure 7:
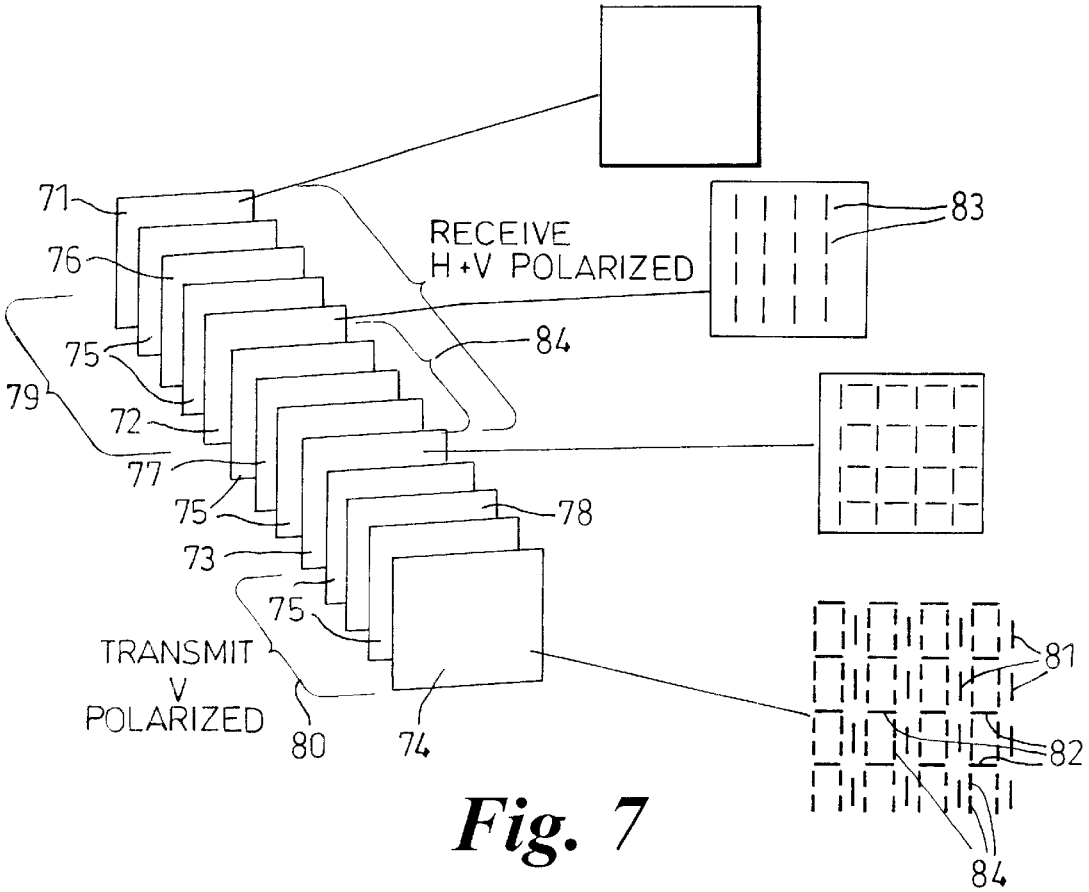
FIG. 7 is an exploded schematic diagram of a flat plate array antenna.

FIG. 7 is an exploded view of a dual band flat plate array antenna. In order for the antenna to operate at two frequency bands, two sets of single band antenna elements are provided one for transmitting and one for receiving. Each set of single band antenna elements is provided as part of a flat plate array or triplate 79, 80.

Each triplate 79, 80 comprises a power supply circuit plate 76, 78 which is formed from plastic film or other suitable electrically insulating material and upon which probes and a distribution network are provided. Any suitable form of probes and distribution network can be used. The probes are connected to each other by stripline sections (not shown) and all the stripline sections are connected to a common stripline feed structure (not shown) in accordance with known techniques to effect reception or transmission of signals in the required frequency bands. Each triplate 79, 80 also comprises a back plate 71, 73 which acts to reflect radiation towards the upper layers and out of the flat plate array and a punched plate 72, 74 which contains an array of apertures 81. For example, the apertures may be slots or circular holes. The back plate 71, 73 and punched plates 72, 74 are ground planes and are formed from aluminium, copper clad Mylar (trade mark) or other suitable material. The plates within each triplate 79, 80 are spaced apart using foamed plastic spacers 75 or spacers formed from any suitable dielectric material.

Each probe in a distribution network 76, 78 is positioned so that it falls within one of the apertures in the punched plate 72, 74 above it, in order to form a single band antenna element. If slots are used in the punched plates 72, 74, vertical slots operate for horizontally polarised radiation and horizontal slots operate for vertically polarised radiation.

As shown in FIG. 7 the triplates 79, 80 are positioned one above the other. However, this is done such that the antenna elements of one triplate do not overlie the antenna elements of the other triplate. In addition, regions 81 of the upper triplate 78 are removed in order that the antenna elements 83 of the lower triplate are able to radiate through the upper triplate 80. This is described in more detail with reference to FIGS. 9 to 14 below.

In a preferred embodiment both horizontally and vertically polarised receive antenna elements are provided together with vertically polarised transmit antenna elements. However, it is not essential to use horizontally and vertically polarised elements in this way. Other types of polarised elements may be used, such as circularly polarised elements. Referring to FIG. 7 the lowest triplate 79 provides vertically polarised receive antenna elements by virtue of vertical slots 83 in the punched plate 72. A third triplate or flat plate array is then provided 84 to give horizontally polarised antenna elements at the same frequency band and the antenna elements of the lowest triplate 79. This is achieved as illustrated in FIG. 7 by using the punched plate 72 of the lowest triplate 79 as the back plate of the third triplate 84. A third distribution network is provided on plate 77 and punched plate 73 forms the upper layer of the third triplate 84. Punched plate 73 contains both horizontal and vertical slots, with the vertical slots being identical to those in the punched plate 72 of the lowest triplate. This allows the antenna elements of the lowest triplate to radiate through the vertical slots in the punched plate 73 of the third triplate. The horizontal and vertical slots in punched plate 73 are of the same size and the array of horizontal slots when rotated 90° corresponds to the array of vertical slots.

As shown in FIG. 7 the punched plate 74 of the uppermost triplate 80 contains horizontal and vertical slots that are identical to those in the lower triplates. However, it is not essential for these slots to be identical as long as the antenna elements of the lower triplates are able to operate through the upper triplate. In addition, the punched plate 74 of the uppermost triplate 80 contains vertical slots 84 which are smaller than the other slots and form part of the transmit antenna elements. Because the vertical slots 84 are smaller and have a different spacing that the other slots they form antenna elements which operate at a different frequency band.

The uppermost and lowermost triplates 79, 80 differ from one another in the sizes of the apertures in the punched plates 72, 74 in order that each triplate operates at a different frequency band. The centre-to-centre spacing between the apertures should be less that one wavelength in order that grating lobes are avoided. However, it is also required to increase the centre-to-centre spacing between the apertures as much as possible in order to increase the space available for the distribution network. For a given triplate, the apertures preferably have a length of about ½ a wavelength, although the apertures are designed to be as small as practically possible for efficient operation of the antenna.

The beamwidth associated with each triplate is related to the wavelength and it is not necessary for these beamwidths to be equal. For example, the transmit beamwidth for a subscriber satellite communication system can be smaller than for the receive beamwidth.

In a particular embodiment the thicknesses of the components in each triplate 79, 80, 84 are as follows:

| | |
|---|---|
| Back plate | 0.6 mm |
| Plastic foam spacer | 1 mm |
| Power supply circuit layer | 0.1 mm |
| Plastic foam spacer | 1 mm |
| punched plate | 0.6 mm |

In the example shown in FIG. 7, four transmit elements are shown for about every receive element and in this way the gain of the transmit beam exceeds that of the receive beam.

In the embodiment being discussed, the Tx band is about 30 GHz and the Rx band about 12 GHz. This gives a 2:5 ratio in wavelengths between the two bands. This means that the element spacing for the receive elements and the transmit elements should be in approximately the same ratio in order that the spacing is always just less than one wavelength. The grid illustrated in FIG. 7 has a ratio of 2:1 which is approximately 2:5 and operates satisfactorily. The transmit elements 84 are arranged in a square grid within a larger grid formed by the receive elements 81, 82.

Figure 9:
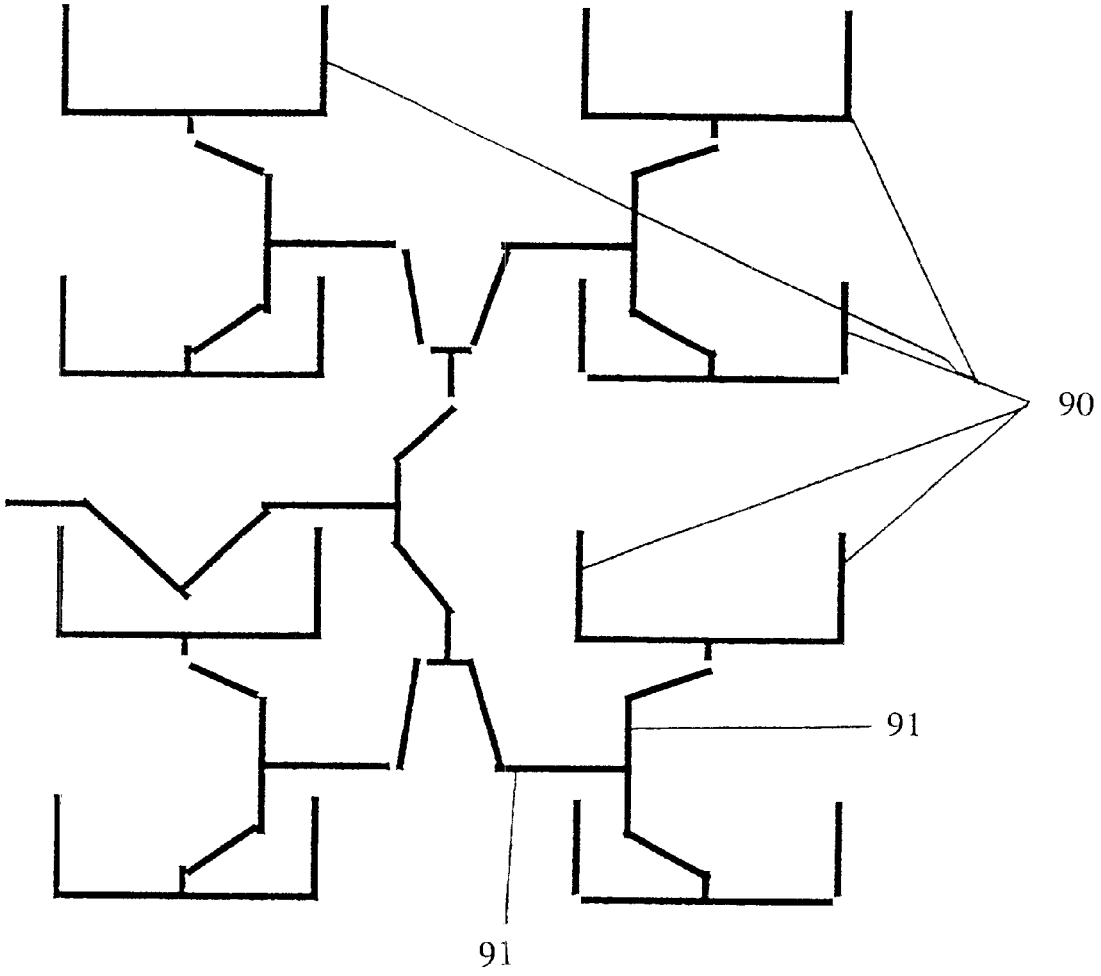
FIG. 9 shows a distribution network for use in the flat plate array antenna of FIG. 7.

FIGS. 9 to 14 illustrate the structure of the triplate layers for one example of a flat plate antenna array. FIG. 9 shows the form for a first distribution network suitable for use in a lower most triplate of an antenna, for example, layer 76 in FIG. 7. This first distribution layer 76 is located above a back-plate 71 with a layer of foam 75 in-between. As described above a plurality of probes 90 are provided (sixteen in FIG. 7) and these are connected together by stripline sections 91. In the example shown in FIG. 7 each probe 90 is positioned parallel with the vertical axis of the page and together the probes form an array. The distribution network is supported on a dielectric sheet or film for example, of plastics material.

Figure 10:
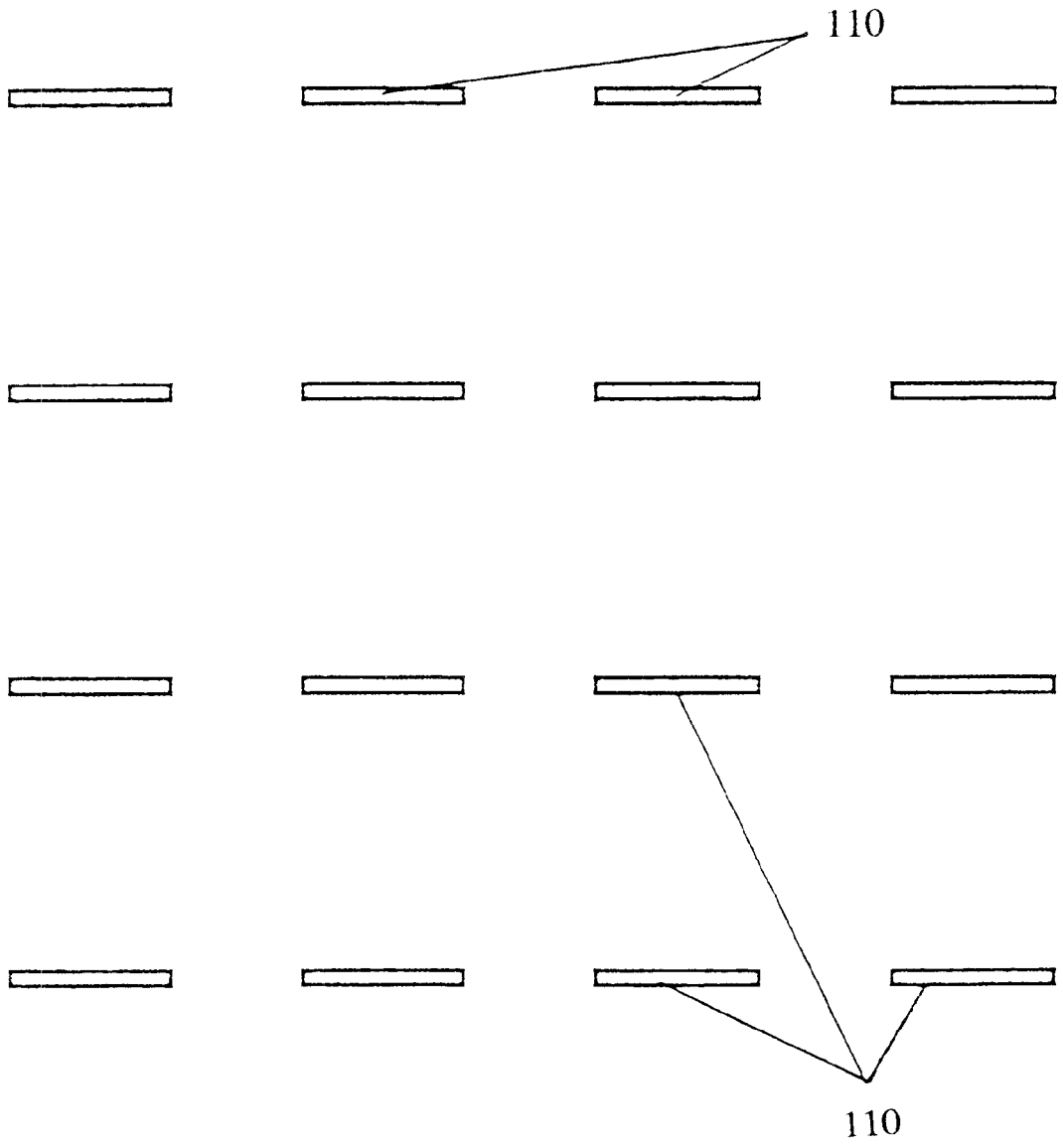
FIG. 10 shows a punched plate for use in the flat plate array antenna of FIG. 7.

Above the first distribution network layer 76 another foam spacer 75 is provided and then a first punched plate 72 which acts as a ground plane. The first punched plate is formed of metal such as aluminium, or alternatively material such as copper clad Mylar (trade mark). An array of apertures 110 is formed in the first punched plate 72, as shown in FIG. 10. Each aperture 110 is in the form of a slot but other suitable shapes of aperture may be used as is known in the art. The apertures 110 are positioned such that each one overlaps a probe 90 in the first distribution layer 76 below. This can be see by superimposing FIGS. 9 and 10. The slot apertures 110 are positioned parallel to the horizontal axis of the page or flat plate array and so are at 90° to the probes 90 in the lower first distribution layer 76. Also, in this example, each slot aperture 110 is positioned so that it crosses or overlaps a probe at a location along that probe of approximately ¼ of a wavelength from its end. In this way, each slot aperture 110 and the probe 90 that it overlies form an antenna element that is vertically polarised.

Figure 11:
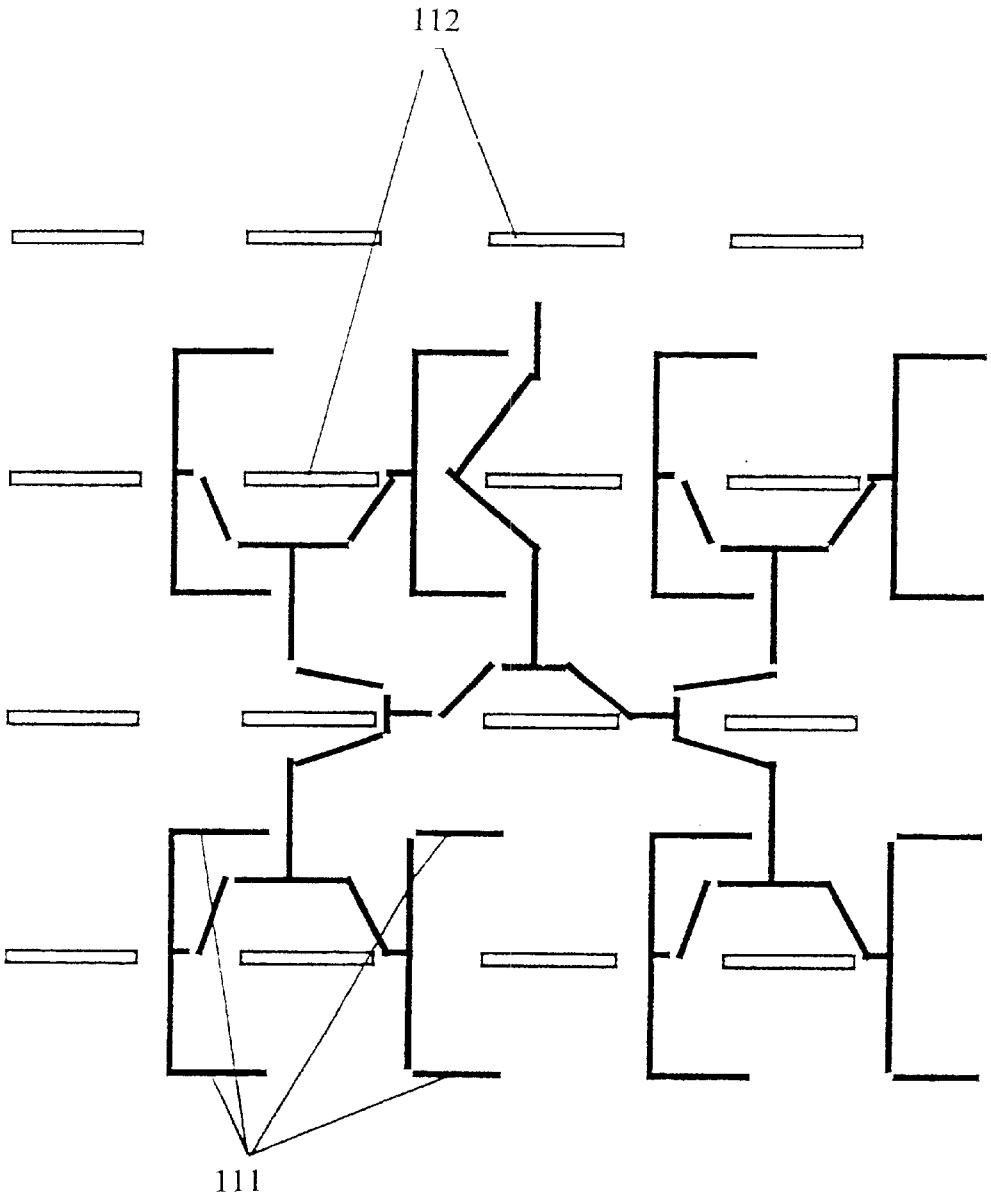
FIG. 11 shows a distribution network for use in the flat plate array antenna of FIG. 7.
Figure 12:
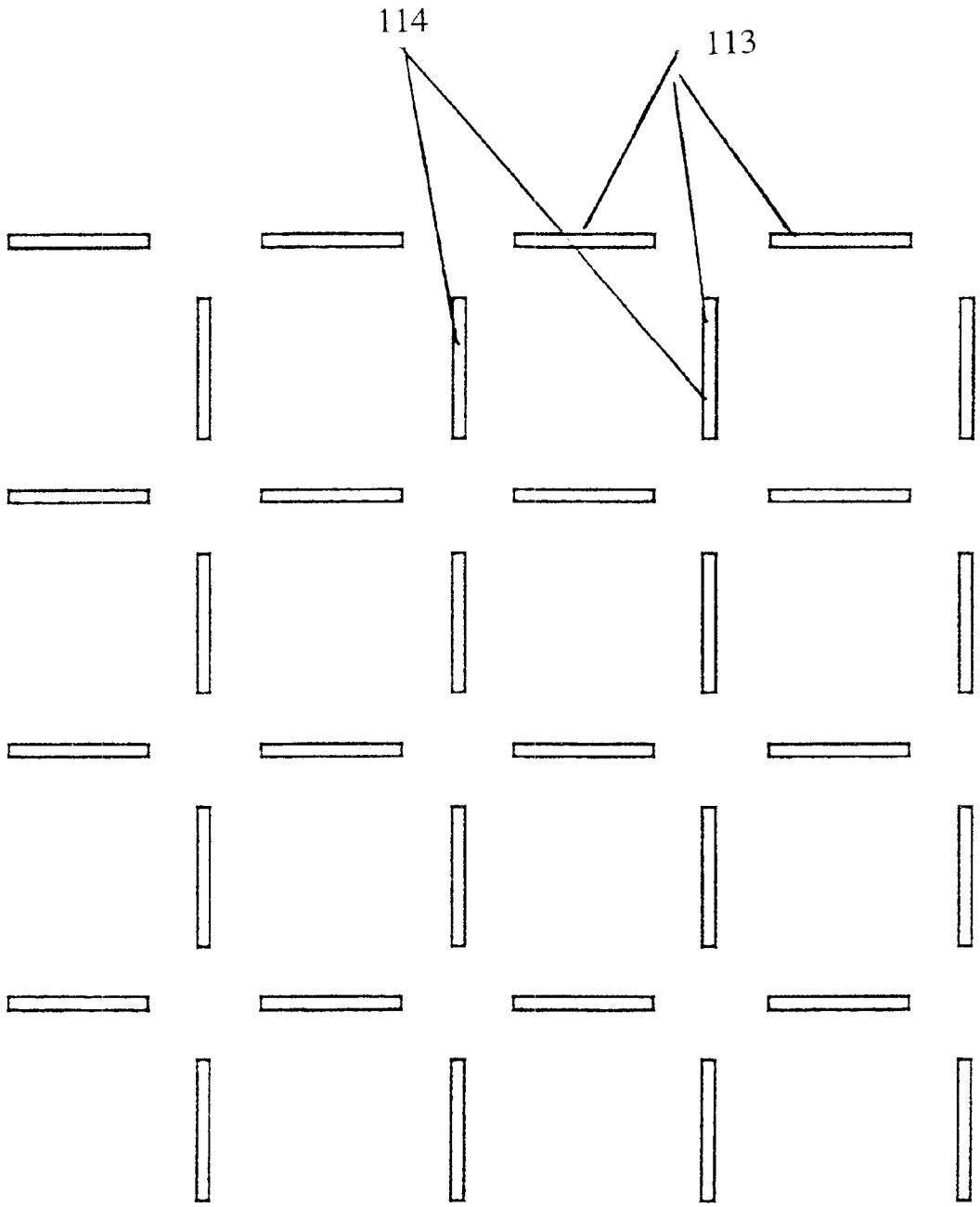
FIG. 12 shows a punched plate for use in the flat plate array antenna of FIG. 7.

Above the first punched plate 72 illustrated in FIG. 10, a foam spacer 75 is provided and above that a second distribution layer 77. This second distribution layer is illustrated in FIG. 11 and provides sixteen probes 111 positioned parallel to the horizontal axis of the page. As for the first distribution layer 76 the probes 111 are connected together by stripline sections and the whole distribution network is supported on a film such as a plastics sheet.

Apertures 112 are provided in the second distribution layer. These apertures 112 correspond in shape, size and position to the apertures 110 in the first punched plate 72. The second distribution network 77 is arranged so that it does not overlie apertures 110 in the first punched plate. This is achieved by positioning the second distribution network 77 between the apertures 112 in the second distribution layer.

Above the second distribution layer 77 a foam spacer 75 is provided and then a second punched plate 73. This second punched plate 73 contains slot shaped apertures 113, 114 and is formed of suitable material in the same way as for the first punched plate 72. Two sets of slot shaped apertures are provided 113, 114 with one set 113 corresponding in shape, size and position to the apertures 112 in the second distribution layer and also to the apertures 110 of the first punched plate. The other set 114 of slot shaped apertures is an array of apertures with their longitudinal axes parallel to the vertical axis of the page. This array has the same spacing as the array of the first set of apertures 113 and together the two arrays form a grid structure. The size and shape of the apertures in the two sets 113, 114 are approximately the same.

The second set of apertures 114 cross over probes 111 in the second distribution network 77. As for the first triplate 79, each aperture 114 crosses over a probe 111 with the aperture 114 and probe 111 at 90° to each other. In this way, each aperture 114 and probe 111 together form an antenna element that is horizontally polarised. The second punched plate 73, second distribution network layer 77 and the first punched plate 72 together form a second triplate 84. The first punched plate 72 acts as a back plate for this second triplate 84.

Figure 13:
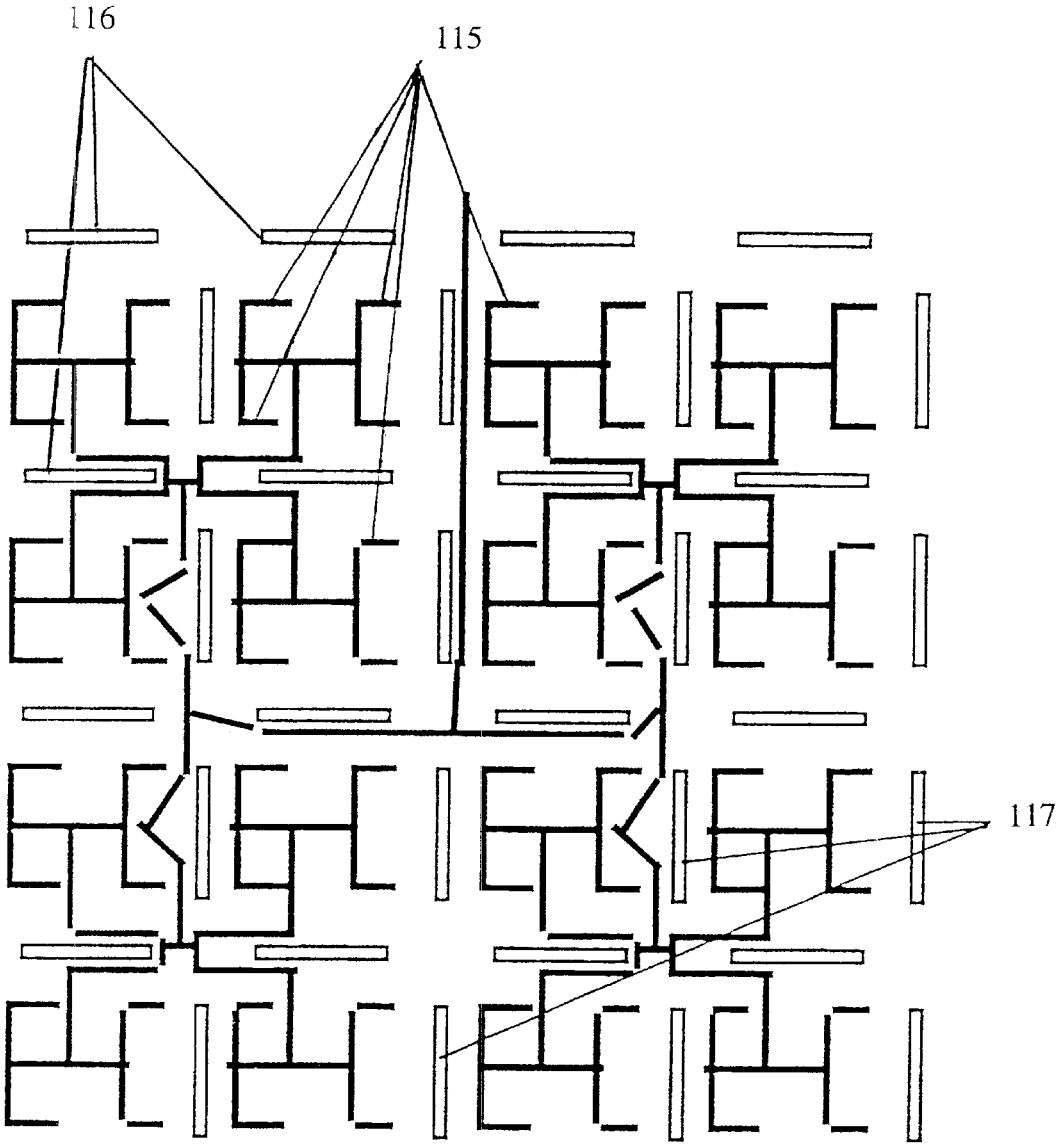
FIG. 13 shows a distribution network for use in the flat plate array antenna of FIG. 7.

Above the second punched plate 73 a foam spacer 75 is placed and above this a third distribution network 78 which is illustrated in FIG. 13. An array of probes 115 are provided, again connected by stripline sections. Each probe is positioned with its longitudinal axis parallel to the horizontal axis of the page and in the example shown in FIG. 13, 64 probes are provided. This gives four times as many probes as in either of the first or second triplates 79, 84. The probes of the third distribution network are also shorter than those of the first and second distribution networks in order the required frequency band is achieved.

Two sets of slot shaped apertures 116, 117 are provided in the third distribution network 78. The apertures 116 of one set correspond in shape size and position to the apertures 110 in the first punched plate 72 and the apertures of the other set 117 correspond in shape size and position to the vertically oriented apertures 114 of the second punched plate 73. As for the first and second distribution networks, the third distribution network is arranged so that it is located between the apertures 116, 117.

Figure 14:
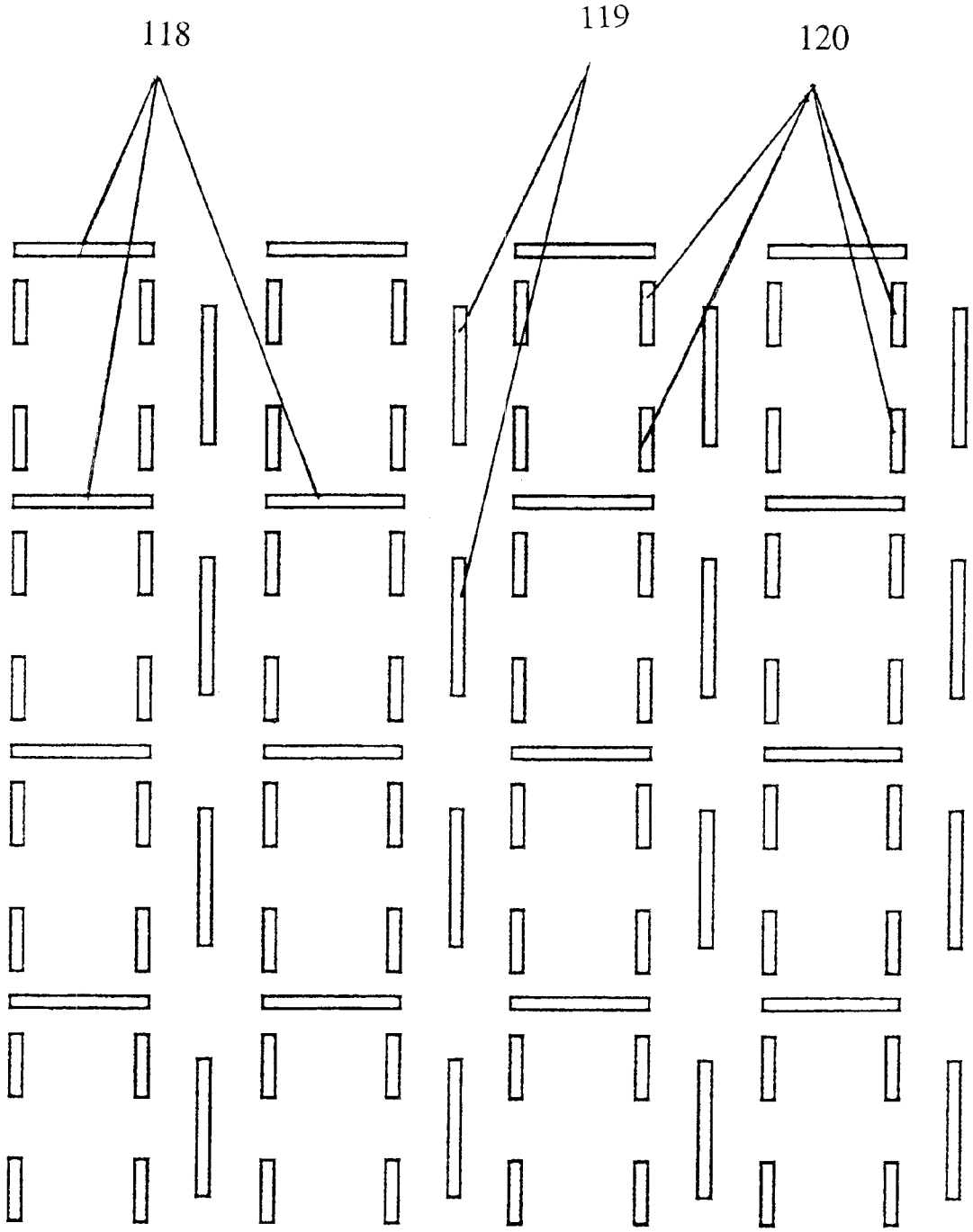
FIG. 14 shows a punched plate for use in the flat plate array antenna of FIG. 7.

Above the third distribution network 78 a foam spacer 75 is located and then a third punched plate 74. This third punched plate contains slot shaped apertures, for example, as shown in FIG. 14. Of these apertures a plurality 118, 119 correspond in shape, size and position to those apertures in the second punched plate 73. The remaining apertures 120 are positioned with their longitudinal axes parallel to the vertical axis of the page. Each of these remaining apertures 120 crosses over a probe 115 in the third distribution network below and is positioned at 90° to the probe 115 that it crosses over. Together each of the remaining apertures 120 and the probe 115 that it crosses over form an antenna element that is horizontally polarised. In a preferred example, these horizontally polarised antenna elements operate at about 30 GHz and the slot size is approximately 5 mm×0.5 mm with a spacing of 9.5 mm.

The third punched plate 74, third distribution network 78 and second punched plate 73 together form a third triplate 80. Here the second punched plate 73 acts as a back plate in a flat plate array antenna.

The antenna elements of the first triplate 79 are able to operate through the second and third triplates 84, 80 because apertures corresponding to those in the first punched plate 72 are provided through the second and third triplates. Similarly, the antenna elements of the second triplate 84 are operable through the third triplate 80 because apertures corresponding to those in the second punched plate 73 are provided through the third triplate.

The arrays of antenna elements in the three triplates 79, 80, 84 can be increased by simply extending the arrays as long as the distribution networks can be accommodated in the space available between the required apertures.

The particular sizes, spacings and locations of the apertures and probes in the example discussed above are only one possibility. Alternative arrays of antenna elements may be used according to the frequency bands required. Also, it is not essential to include the second triplate 84 if antenna elements of only one polarisation are required.

Dual Band Feeds for Reflector Antennas

Examples of dual band feeds for reflector antennas are now described. These dual band feeds may also all be used as antennas in their own right. The examples all involve using an array of single band antenna elements of a first frequency band arranged around an antenna with a similar beamwidth as the surrounding array of antenna elements. The central antenna operates at a second frequency band, different from that of the outer array of elements. For example, the central antenna may be a flat plate array, an array of dipole elements, a horn or any other suitable antenna. The outer array of antenna elements may be flat plate elements, dipole elements or any other suitable type of antenna elements. Also, by virtue of the arrangement of the central antenna and the surrounding antenna elements, the two antenna beams produced are approximately concentric such that the dual band antenna operates effectively.

In each of these examples, two antenna beams are created using the array feed, one for an up-link communication channel and one for a down-link communication channel. These antenna beams must have approximately co-incident phase centres and approximately equal beamwidths in order to illuminate a reflector effectively and efficiently. As well as this the array feed should be low cost, enable monopulse alignment methods and distributed power amplification to be used and also be small in size.

Dual Band Flat-plate Array Feed for a Reflector Antenna

Figure 15:
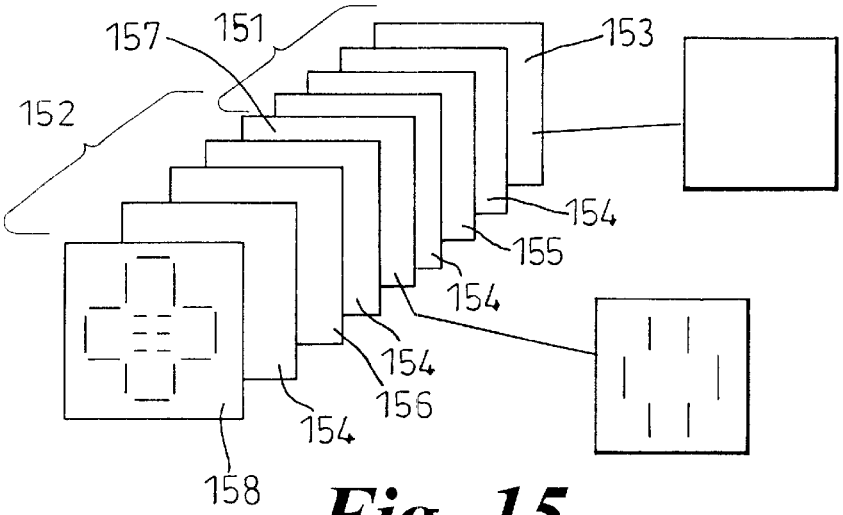
FIG. 15 is an exploded, schematic diagram of a flat plate array feed for a reflector antenna.

FIG. 15 illustrates a dual band flat plate array feed for a reflector antenna that is suitable for providing horizontal and vertical polarised antenna elements for operation at about a 12 GHz receive band and vertical polarised antenna elements for operation at about 30 GHz transmit band. Two triplates are effectively provided 151, 152 one for receive antenna elements of one polarisation and the other for receive antenna elements of another polarisation and transmit antenna elements.

A first triplate comprises a back-plate 153, a first distribution network layer 155 and a first punched plate 157 with these layers being spaced apart using foam spacers 154 in a similar way as for the flat plate array antenna described above. The first distribution network provides, for example, six probes connected together using stripline sections. As for the flat plate array antenna described above the probes are of the same size and shape and are arranged in an array with their longitudinal axes being parallel.

The first punched plate 157 contains slot shaped apertures, one for each probe in the first distribution network. The slot shaped apertures are of the same size and shape and are arranged in an array with their longitudinal axes at 90° to the longitudinal axes of the probes in the first distribution network. As for the flat plate array antenna described above the slot shaped apertures cross over probes in the first distribution network to form first antenna elements of either horizontal or vertical polarisation.

Above the first punched plate 157 is a foam spacer 154 and above this a second distribution network 156. The second distribution network contains one set of probes to form antenna elements which operate at the same frequency but opposite polarisation to the first antenna elements. A second set of probes is also provided in the second distribution network. This second set of probes form part of second antenna elements which operate at a different frequency band from the first antenna elements. As described above for the flat plate array antenna, the second distribution network contains apertures which correspond to those in the first punched plate.

Another foam spacer is placed over the second distribution network and above this a second punched plate 158. The second punched plate 158 contains slot shaped apertures which correspond to those in the first punched plate. In addition, apertures are provided, to form antenna elements of the same frequency range as the first antenna elements but of an opposite polarisation. Also, apertures are provided to form antenna elements of a different frequency to the first antenna elements.

Figure 34:
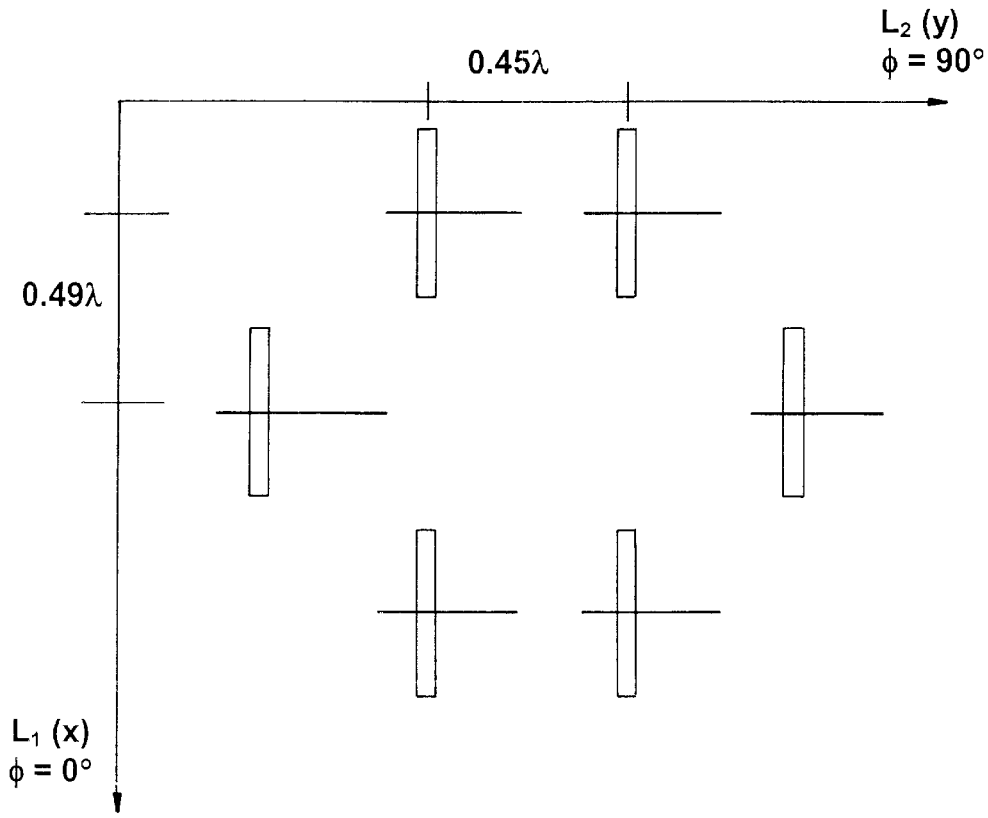
FIG. 34 shows the relative positions of slot apertures in a punched plate.

In one embodiment the slot shaped apertures in the first punched plate are positioned as shown in FIG. 34 with the horizontal spacing between the centres of the pairs of slot shaped apertures being 0.45 wavelengths and the vertical spacing between the centres of pairs of slot shaped apertures being 0.49 wavelengths. This array design was analysed using LINPLAN (trade mark). The slot dimensions were nominally 1 mm×11 mm and the frequency specified at 12.75 GHz. For the example illustrated in FIG. 34, a 3×4 element array was simulated in LINPLAN with an amplitude variation as shown below:

| | | | |
|---|---|---|---|
| 0 | 1 | 1 | 0 |
| 1 | 0 | 0 | 1 |
| 0 | 1 | 1 | 0 |

For the azimuth radiation pattern cut LINPLAN indicated that the 10 dB beamwidth was 59° and the highest sidelobe level −18.97 dB. For the elevation radiation the 10 dB beamwidth was 61° and the highest sidelobe level −23.86 dB. The directivity was 13.64 dBi.

Figure 35:
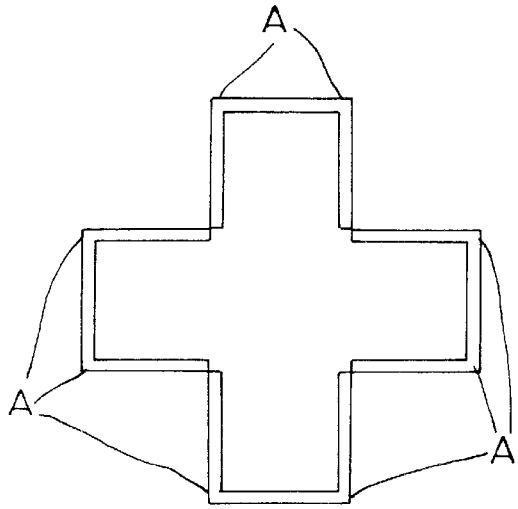
FIG. 35 shows the result of duplicating the slot apertures of FIG. 34 and rotating the duplicate slots 90° with respect to the slots of FIG. 34.

These slots in the first punched plate are used to form either horizontally or vertically polarised receive elements. In order to form antenna elements of the opposite polarisation, slots are provided in the second punched plate. These slots in the second punched plate form an array which corresponds to the array of apertures in the first punched plate with a 90° rotation. FIG. 35 shows the result of repeating the array of slots from the first punched plate, rotating these 90° and combining these with the first array of slots. It can be seen that the slots overlap one another as shown at A in FIG. 35. This is not desirable because any antenna elements in a triplate below the punched plate will not radiate through the covering slots efficiently. The inter-slot spacing was adjusted to remove the overlapping regions and also to maximise the space between the slots which is available for accommodating the distribution or beamformer network. In this way the arrangement shown in FIG. 36 was obtained. Here the horizontal distance between the central vertical slots has been increased from 0.45 wavelengths to 0.55 wavelengths. Similarly, the vertical distance between the central horizontal slots has been increased from 0.45 wavelengths to 0.55 wavelengths. In order to maintain the outer dimensions of the array, and consequently the beamwidth, these increases in spacing are counteracted by decreases in spacing between the outer vertical elements (the horizontal distance between these is now 0.4 wavelengths) and between the outer horizontal elements (the vertical distance between these is now 0.4 wavelengths).

Figure 36:
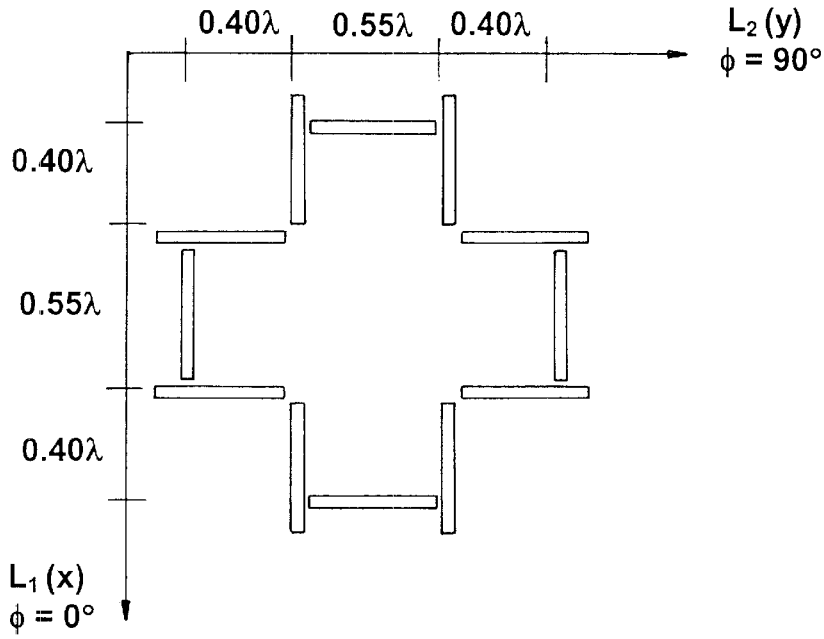
FIG. 36 shows the relative positions of slot apertures in a punched plate.

In a preferred embodiment of the flat plate array feed, the arrangement of slots shown in FIG. 36 is used for the horizontally and vertically polarised receive antenna elements. An amplitude taper (in volts) is applied to this array as follows:

| | | | |
|---|---|---|---|
| 0 | 0.85 | 0.85 | 0 |
| 1 | 0 | 0 | 1 |
| 0 | 0.85 | 0.85 | 0 |

Using LINPLAN to analyse the arrangement illustrated in FIG. 36, together with the amplitude taper described above, the following results were obtained for a frequency of 12.75 GHz. For a pattern cut of 0° the 10° beamwidth was 55° and the highest sidelobe level −18.72 dB. For a pattern cut of 90° the 10° beamwidth was 55° and the highest sidelobe level −11.05 dB. The directivity was 13.22 dBi. With a frequency of 11.725 GHz the 10° beamwidths were 59° for both the 0° and 90° pattern cuts. This illustrates the effect of frequency on the beamwidth.

In the embodiment where the arrangement of slots for the receive antenna elements is as shown in FIG. 36, the slots for the transmit band antenna elements are conveniently located within the centre of the array of receive antenna slots. This is illustrated schematically in FIG. 15 on the second punched plate 158. That is, the arrangement of slots for the receive antenna elements as shown in FIG. 36 is particularly advantageous because it allows room for transmit band antenna elements. It is not essential to use slot shaped apertures; any suitable shape of apertures such as circular apertures can be used in the arrangement shown in FIG. 36. The receive (or transmit) antenna elements are positioned in a cross like formation such that the elements do not overlap and such that a region in the centre of the cross is available for transmit (or receive) band antenna elements.

Other arrangements for the receive and transmit element slots are possible. FIGS. 33A to D shows possible arrangements for horizontal and vertically polarised antenna element slots. Arrangement C has already been discussed above. In each of these arrangements, slots for the transmit elements need to be incorporated whilst allowing enough space to accommodate the required distribution networks. Also, the transmit element slot array should be arranged such that it is approximately concentric with the receive element slot array in order that the antenna beams have co-incident phase centres.

Figure 16:
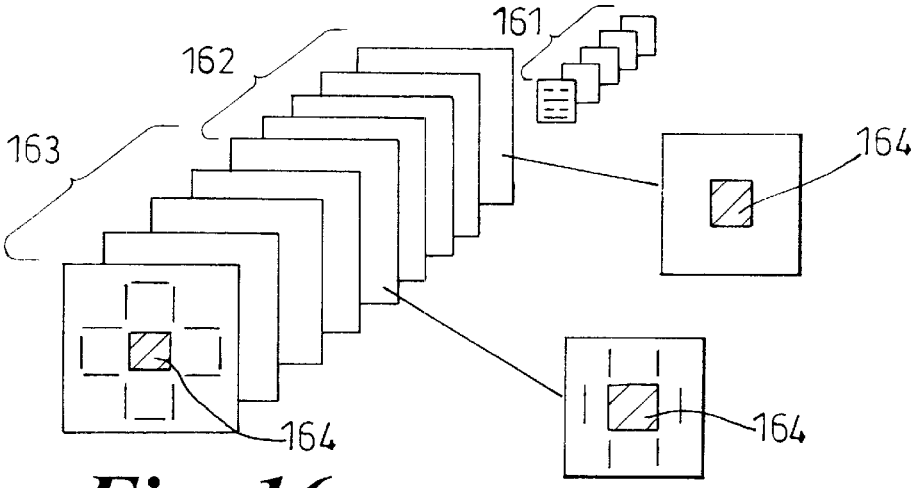
FIG. 16 is an exploded, schematic diagram of another flat plate array feed for a reflector antenna.

FIG. 16 illustrates an alternative embodiment of the flat plate array feed for a reflector antenna. FIG. 16 shows a flat plate array feed which is similar to that of FIG. 15 except that three triplates, 161, 162, 163 are used. Also, the upper two triplates 162, 163 contain a central aperture 164 extending through their centres. The antenna elements of the lowest triplate 161 are positioned below the central aperture 164 in order that the lowest triplate 161 is operable through the other triplates. In this way the size of the lowest triplate 161 can be varied as long as its antenna elements are below the central aperture 164. One upper triplate 162 provides antenna elements that are polarised in one direction and the other upper triplate 163 provides antenna elements that are polarised in the other direction. Also, as in the flat plate antenna array discussed above, apertures in upper triplates are used to allow antenna elements in lower triplates to operate through the upper layers. The same positioning of slot shaped apertures in the punched plates may be used as for the embodiment of FIG. 15 except that the antenna elements of different frequencies are separated into separate triplates.

Figure 17:
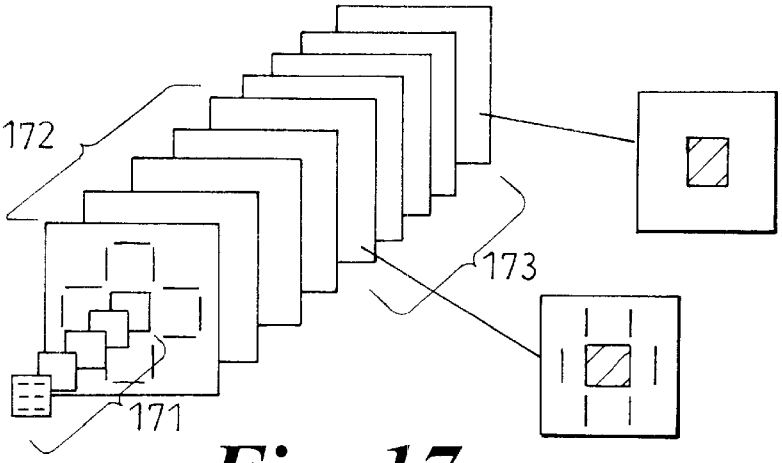
FIG. 17 is an exploded, schematic diagram of another flat plate array feed for a reflector antenna.

FIG. 17 illustrates another embodiment of a flat plate array feed for a reflector antenna. This is similar to th embodiment of FIG. 16 but with the order of the triplates changed. Again three triplates 171, 172, 173 are used. This time, the lower triplates 172, 173 contain a central aperture 164 extending through these plates. The upper triplate 171 is positioned above the central aperture 164 and thus is not practically affected by antenna elements in the lower triplates.

Figure 37:
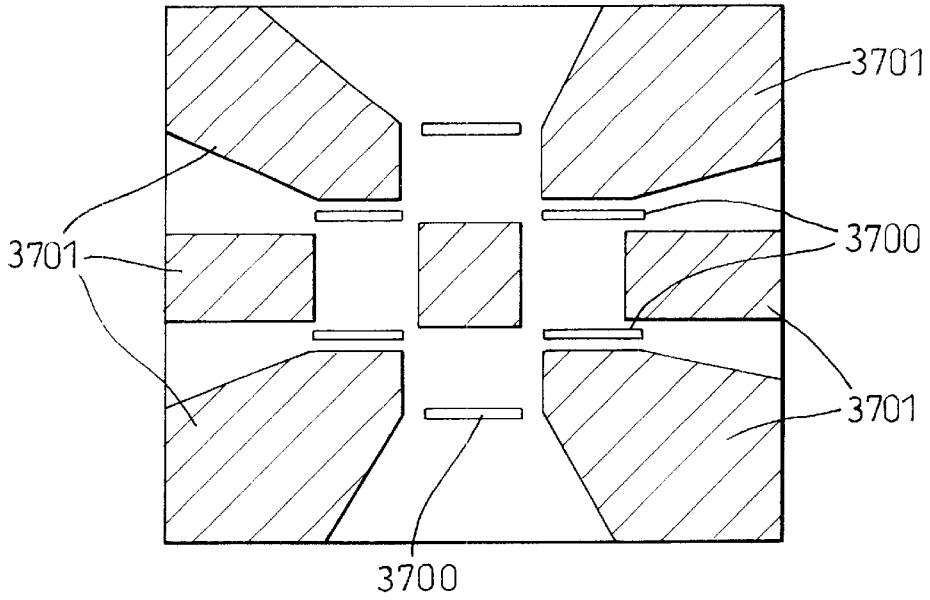
FIG. 37 shows slot apertures in a punched plate with cut away portions.
Figure 38:
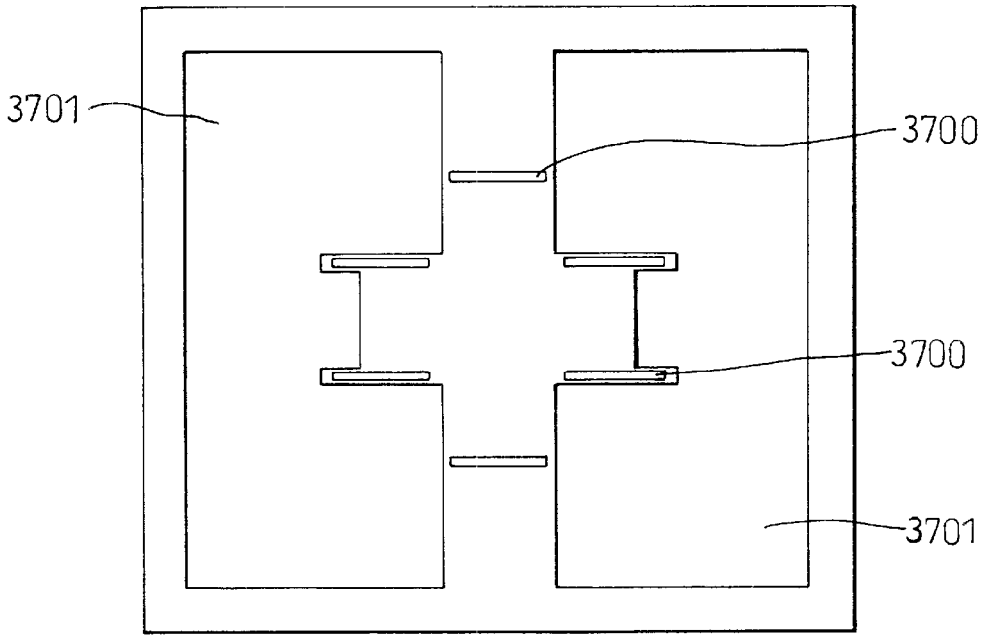
FIG. 38 shows another example of slot apertures in a punched plate with cut away portions.

In the flat plate feeds discussed above, it is also possible to use cut away portions in the punched plate of the uppermost triplate. For example, in the example shown in FIG. 15, the uppermost punched plate 158 may take the form illustrated in FIG. 37 or that illustrated in FIG. 38. In FIG. 15 the six vertical slots of the outer array do not form antenna elements as such but rather allow antenna elements from the lower triplate to operate. However, the six horizontal slots of the outer array do form antenna elements. These six horizontal slots 3700 are present in the punched plates shown in FIG. 37 and 38. However, instead of providing vertical slots as such the punched plates of FIG. 37 and 38 have cut away portions 3701 which extend over the area that the vertical slots would have been in. These cut away portions can also be thought of as regions of the upper punched plate that have been removed.

In the flat plate feeds discussed above, tapering of the illumination may be employed in order to equalise the beamwidths, as is known in the art.

For the flat plate feeds discussed above the problem of providing enough space between the antenna elements in order to accommodate the distribution network arises again as for the flat plate antenna array described above. However, this problem is not quite so acute because the array feed is small so that the distribution network can be accommodated to some extent in the area around the outside of the array feed. As for the flat plate antenna array the spacing between the elements should be less that one wavelength in order that grating lobes are not created. Because the array feed is smaller than the array for the flat plate antenna discussed above, grating lobes occur for element spacings that are further from one wavelength than would otherwise have been the case. As for the flat plate antenna the aperture sizes are preferably about ½ a wavelength but again should be as small as possible to accommodate the distribution network.

Although the examples of dual band array feeds for reflector antennas discussed above have been described for providing frequency bands of about 30 GHz and 12 GHz, the arrangements can be used for any combination of frequency bands.

Monopulse alignment is possible with the antennas described above because multiple receive antenna elements are available. Also, distributed power amplification is possible with the reflector antennas described above because multiple transmit antenna elements are available.

Dual Band Array Feed for a Reflector Antenna Comprising Dipole Antenna Elements

It is also possible to replace some or all of the flat-plate antenna elements in the array feeds discussed above with dipole or other suitable antenna elements. For example, an array of six dipole elements arranged in the positions of the slots in FIG. 36 may be used with a further array of dipole elements of a different frequency located in the centre of the arrangement of six dipole elements. Dipole elements are stood off from a ground plane as is known in the art. Similarly, an array of six dipole elements arranged in the positions of the slots in FIG. 36 may be used with a further array of single band flat plate antenna elements located in the centre of the arrangement of six dipole elements. Alternatively, an array of dipole elements may be used in the centre with an array of six flat plate elements in the positions of the slots in FIG. 36. Any suitable type of antenna element may be used in place of some or all of the dipole elements in these examples. Also, it is not essential to use only six elements in the outer array. More than six elements may be used. In these examples involving dipole elements it is not essential to use six elements; other numbers and arrangements of elements may be used as discussed above for the dual band flat plate array feeds. Also, the feeds which include dipoles may be used as antennas in their own right.

Combined Horn and Flat Plate Array

It is also possible to combine a horn antenna with a flat plate array to produce a dual band antenna or a feed for a dual band reflector antenna. In the arrangement of slots in FIG. 36 it can be seen that a relatively large rectangular space is available in the centre of the array of slots. In the feeds for reflector antennas discussed above, this space was exploited to locate an array of flat plate antenna elements of a different frequency. However, this space also accommodates a horn as illustrated in FIGS. 18 and 19.

Figure 18:
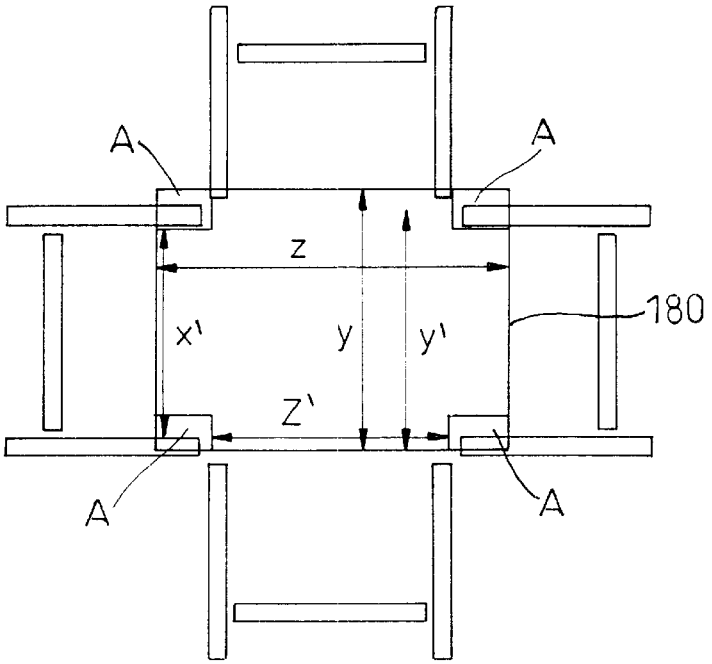
FIG. 18 illustrates the space required for one feed within another feed for a reflector antenna.
Figure 19:
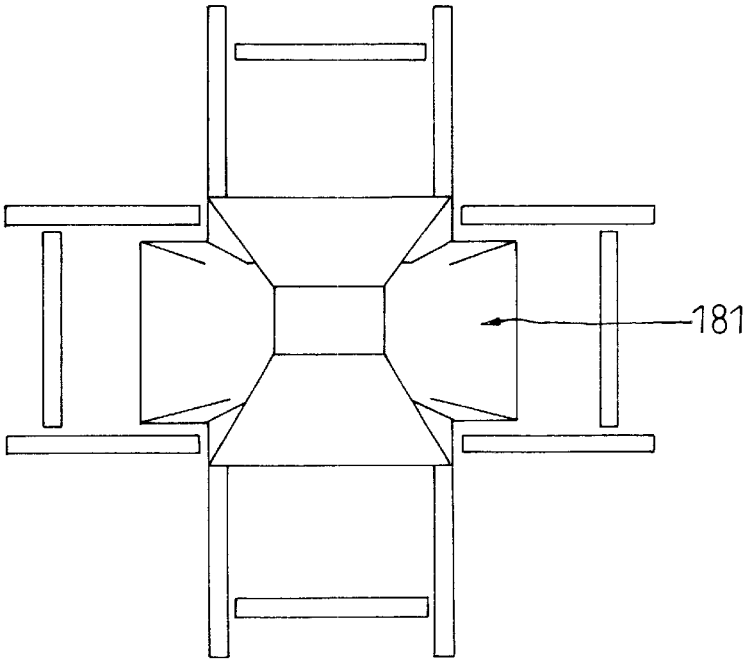
FIG. 19 shows a feed for a reflector antenna comprising a horn within another feed.

The arrangement of slots from FIG. 36 is repeated in FIGS. 18 and 19. FIG. 18 illustrates the size of the space in the centre of the array of slots in one example where X'=11.94 mm; Y'=13.94 mm and Z'=13.94 mm. Rectangle 180 represents the aperture of a rectangular horn whose width, Y=14.5 mm and height, Z=20.3 mm. It can be seen from FIG. 18 that the corners of the horn overlap the slot apertures at A. In order to avoid this, the horn 181 is shaped to fit around the slot apertures as illustrated in FIG. 19.

Figure 20:
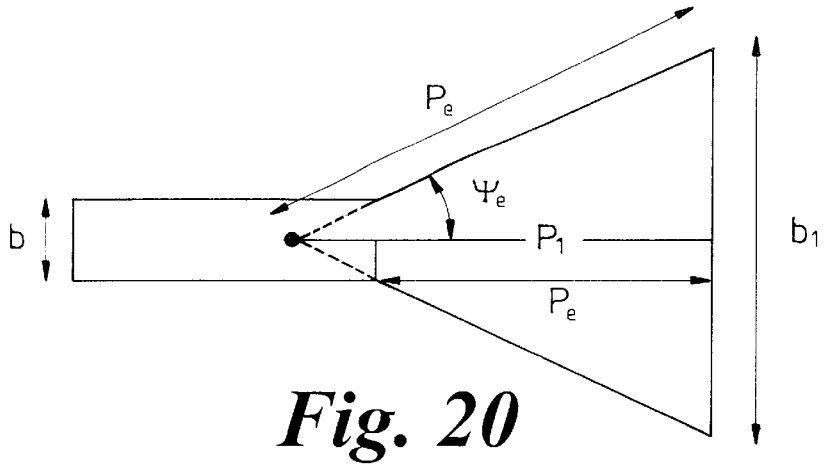
FIG. 20 is a schematic side view of a horn for use in the feed of FIG. 19.
Figure 21:
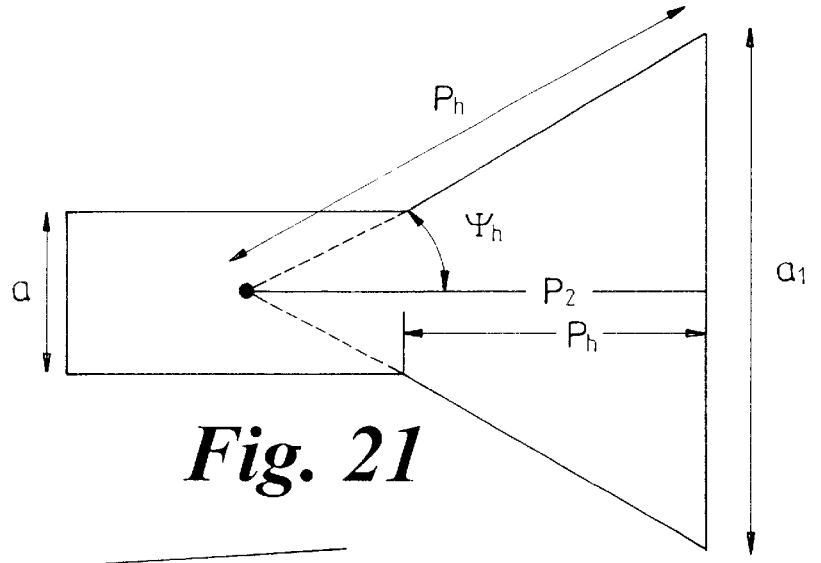
FIG. 21 is a schematic plan view of a horn for use in the feed of FIG. 19.

In one example, a horn and waveguide for operation at about 30 GHz are used. In this case the dimensions of the horn and waveguide are given below with reference to FIGS. 20 and 21: b=3.55 mm; $b_1$=14.5 mm; $\rho_e$=42.68 mm; $\rho_1$=42.05 mm; $\Psi_e$=9.78°; $P_e$=$P_h$=31.76 mm; a=7.1 mm; $a_1$=20.3 mm; $\rho_h$=42.68 mm; $\Psi_h$=11.7°.

Figure 22:
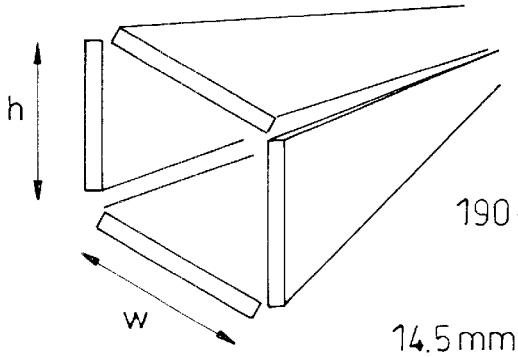
FIG. 22 is a perspective view of a horn.
Figure 23:
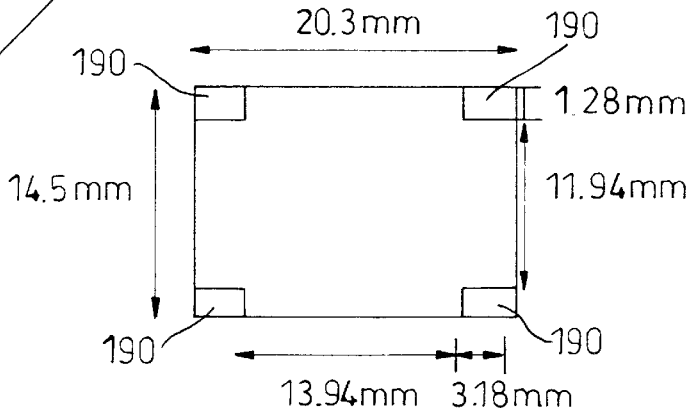
FIG. 23 is an end view of a horn.
Figure 24:
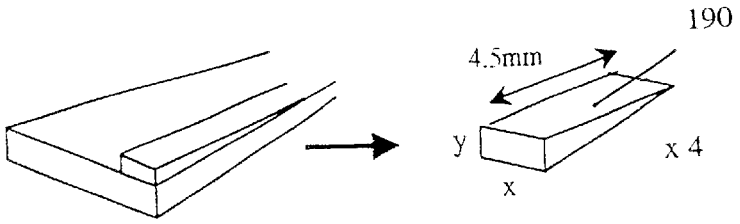
FIG. 24 shows corner pieces for use in a horn.
Figure 25:
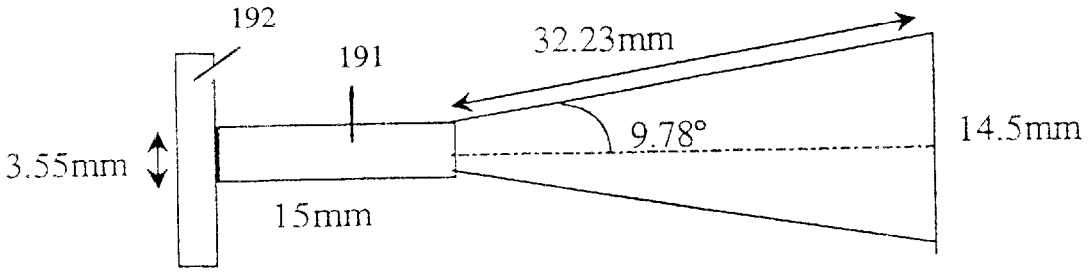
FIG. 25 is a side view of a horn and waveguide for use in the feed of FIG. 19.
Figure 26:
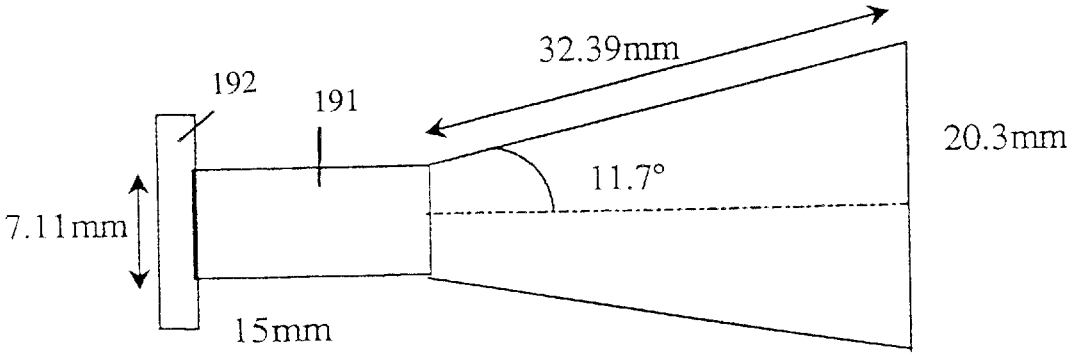
FIG. 26 is a plan view of the horn and waveguide of FIG. 25.

A comparison of the performance of a horn with these dimensions and an equivalent horn with the corners adapted to fit around the slot elements was made. These horns were soldered together in parts as illustrated in FIG. 22 and to one horn, corner pieces were added. FIG. 23 shows the front face of a horn with added corner pieces 190. These corner pieces 190 were machined into the horn and formed as wedge shaped pieces positioned to taper into the horn aperture. FIG. 24 shows the form of the tapered corner pieces 190. FIGS. 25 and 26 show the form of the horn and illustrate how each horn is fed by a waveguide 191 which terminates with a flange 192. Radiation pattern cuts were obtained for the two horns in an anechoic chamber and it was found that little difference in performance resulted from modifying the corners of the horn. Good sidelobe performance was obtained with an acceptable 10 dB beamwidth at approximately 60°.

As mentioned above coupling of a flat-plate antenna and its electronic processor device is in most cases by means of a hollow waveguide with capacitive coupling-in of the radiation summation signal. In the arrangement discussed above, using a horn combined with a flat plate array, the advantage of a relatively simple transition from the horn to a hollow waveguide is obtained.

The combined horn and flat plate array arrangement discussed above may either be used as a dual band antenna in its own right or as a feed for a dual band reflector antenna.

In a preferred embodiment the horn is used for the transmit band at about 30 GHz and the flat plate array is used for a receive band at about 12 GHz. Because the flat plate array comprises a plurality of receive antenna elements the advantage of being able to use monopulse alignment methods is attained.

Combined Horn and Dipole Array

It is also possible to create a dual band feed for a reflector antenna using a horn and a dipole array. In this case, an array of single band dipole antenna elements are arranged around a horn of a second frequency band. The horn and array of dipole elements are arranged to give similar beamwidths and to have coincident phase centres. This arrangement is also functional as a dual band antenna in its own right rather than as a feed. In a preferred example, the flat plate antenna elements in the example discussed above are replaced by dipole elements. For example, the slot elements of FIG. 19 are replaced by dipole elements. This enables more space within the arrangement of dipole elements to be obtained so that it is not essential to remove the corners of the horn as described above. Similarly, other types of antenna element besides dipole and flat plate elements may be used in combination with a horn.

In the examples discussed above which use triplates, it is possible to include connections between two ground planes of a triplate. For example, in the case shown in FIG. 7, the lowermost triplate 79 has a back plate 71 and a punched plate 72 which are two ground planes of the triplate. The connections act as short circuits between two ground planes and provide suppression of parallel plate modes as is known in the art. It is not essential to include these connections however. The connections are most effective when positioned in the vicinity of slot or other apertures of antenna elements in the triplate but it is not essential to locate the connections near apertures.

Figure 8:
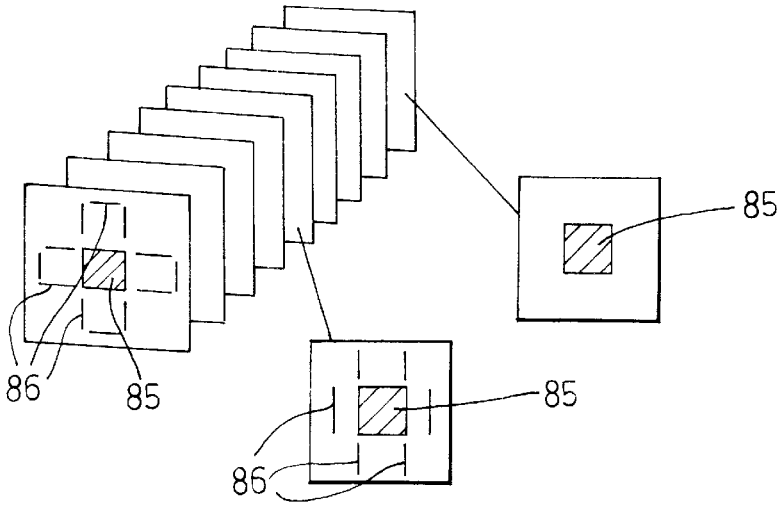
FIG. 8 is an exploded schematic diagram of a flat plate array feed for a reflector antenna.

FIG. 8 shows a dual band antenna which comprises an antenna 85 arranged to operate at in a first frequency band and with a first beamwidth; and a plurality of single band antenna elements 86 arranged to operate at a second frequency band; and wherein said single band antenna elements 86 are positioned around said antenna 85 such that they operate in use with a second beamwidth similar to said first beamwidth.

Construction of Feed Assembly

Figure 27:
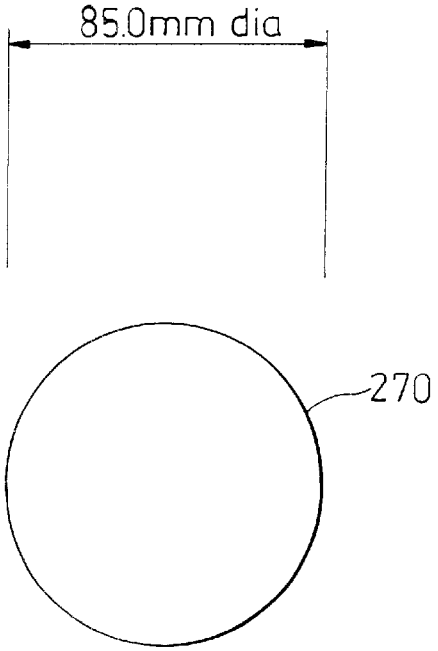
FIG. 27 is a front view of a feed assembly for a reflector antenna.
Figure 28:
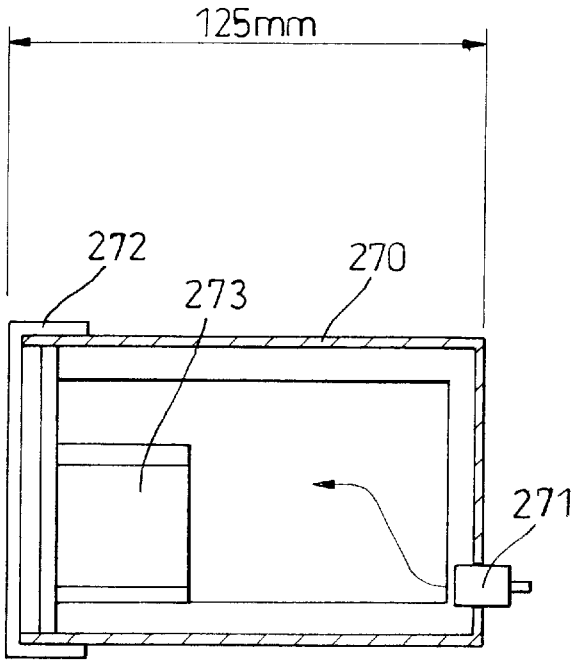
FIG. 28 is a longitudinal cross section through the assembly of FIG. 27.

FIGS. 27 to 31 illustrate how the combined horn and flat plate array are incorporated into a feed assembly for a reflector antenna such as that illustrated in FIG. 3. A cylindrical housing 270 is provided for the feed assembly and a top view of this housing is shown in FIG. 27. The housing 270 is formed of plastics material or any other suitable material. The dimensions shown in FIGS. 27 and 28 are examples only; other dimensions may be used.

Figure 29:
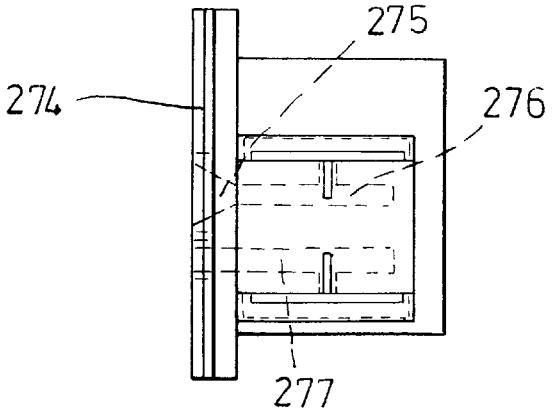
FIG. 29 is a longitudinal cross section through part of the assembly of FIG. 27.

FIG. 28 is a longitudinal cross section through the assembly of FIG. 27. A connector 271 is provided at one end on the cylindrical housing for connecting the feed assembly to a cable which in turn is connected to an indoor unit such as a set-top box in a subscriber's premises. The cylindrical housing 270 has a cover 272 below which a feed assembly 273 is located. FIG. 29 is a longitudinal cross section through this feed assembly and shows a flat plate array 274 positioned to lie parallel to the housing cover 272, and a horn 275 with a waveguide 276 connected to it. Two further waveguides 277 are provided for connection to the flat plate array 274 although only one of these is visible in FIG. 29. The waveguide 277 that is not visible in FIG. 29 is located underneath the visible waveguide that connects to the flat plate array. One of these waveguides provides a connection between antenna elements of one polarisation in the flat plate array 274 and the other waveguide for antenna elements of another polarisation. Thus it is not essential to use two such waveguides. Probes for connecting the flat plate array 274 to the two waveguides are provided, as is known in the art, but are not shown in the Figures. Also "top hats" (not shown) are positioned over these waveguides 274 (as known in the art) to prevent these emitting radiation out of the cover of the feed assembly.

Figure 30:
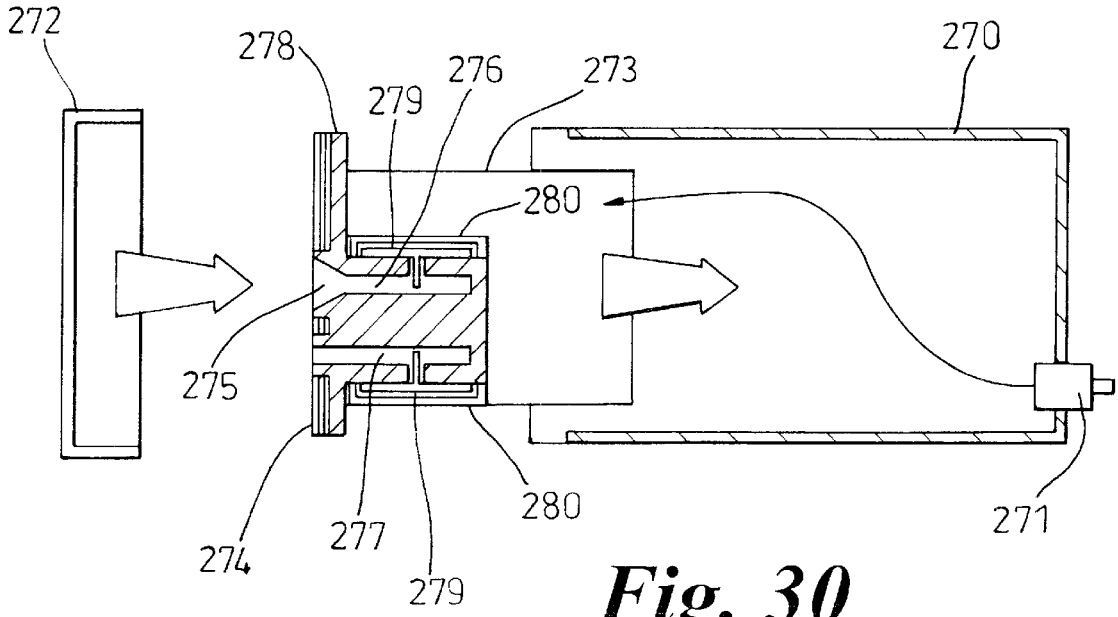
FIG. 30 is an exploded view of the feed assembly of FIG. 27.

FIG. 30 is an exploded view of the feed assembly of FIG. 27. This shows how the feed assembly 273 is inserted into the housing 270 and the cover 272 positioned. The flat plate array 274 is also shown as being supported on a carrier casting 278 within which the horn 275 and waveguides 276, 277 are supported. Each waveguide 276, 277 is connected to a printed circuit board via a probe. The printed circuit boards 279 are positioned parallel to the waveguides as shown and screening cans 280 are placed around the printed circuit boards to prevent escape of electromagnetic radiation.

Figure 31:
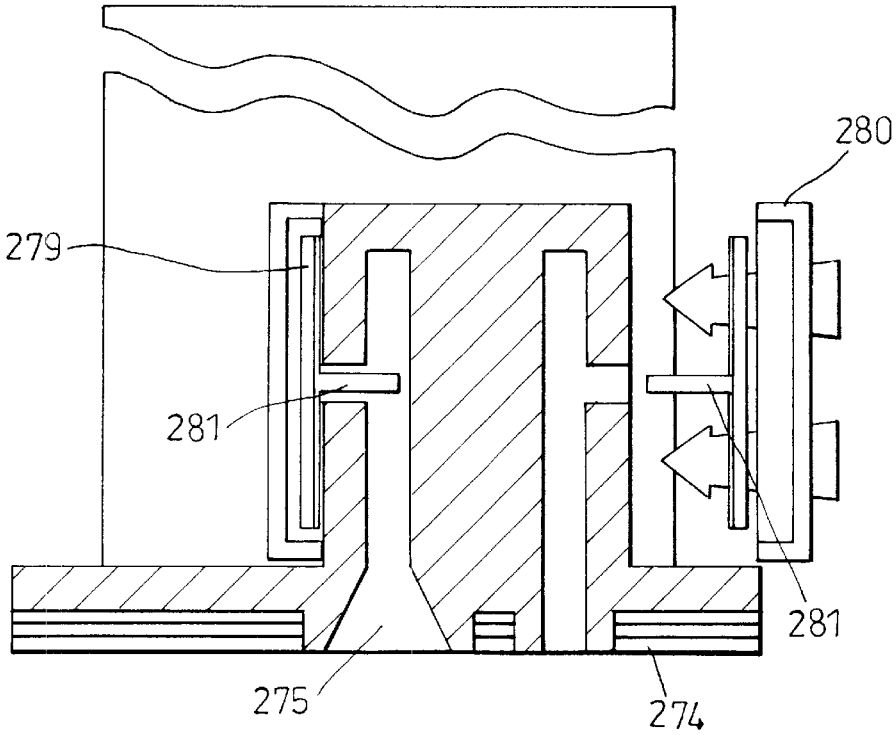
FIG. 31 is a schematic cross section through part of the feed assembly of FIG. 27.

FIG. 31 is a schematic cross section through part of the feed assembly of FIG. 27. It shows way in which the printed circuit boards 279 and screening cans 280 may be fitted directly to the carrier casting 278. Also, the waveguide probes 281 are shown.

By using a single casting 278 to carry the horn 275, waveguides 276, 277, flat plate array 274 and printed circuit boards 279 a simple design is achieved which is easy to manufacture and which is low cost. The one part casting is compact and can be quickly tested compared to alternative structures which use several components. The casting provides a dual function of supporting both the dual band antenna and its associated electronics and using the carrier casting 278 it is ensured that the horn 275 and flat plate array 274 are correctly positioned with respect to one another. The carrier casting 278 is easily formed as a single piece and holes or apertures are then drilled into this single piece using known manufacturing methods which are inexpensive. No special connectors are required to connect the horn, waveguides or flat plate array to the carrier casting; rather conventional low cost fixing means are used where required. As well as this, once the flat plate array 274, horn 275, waveguides 276, 277 and electronics are carried by the casting these items are easily slipped into a protective cover or housing 270 as illustrated in FIG. 30.

Another advantage is that by positioning the screening cans 280 over the printed circuit boards 279 and by using the protective housing 270 and cover 272, unwanted electromagnetic emissions from the assembly are reduced.

Components of Dual Band Antenna

Figure 32:
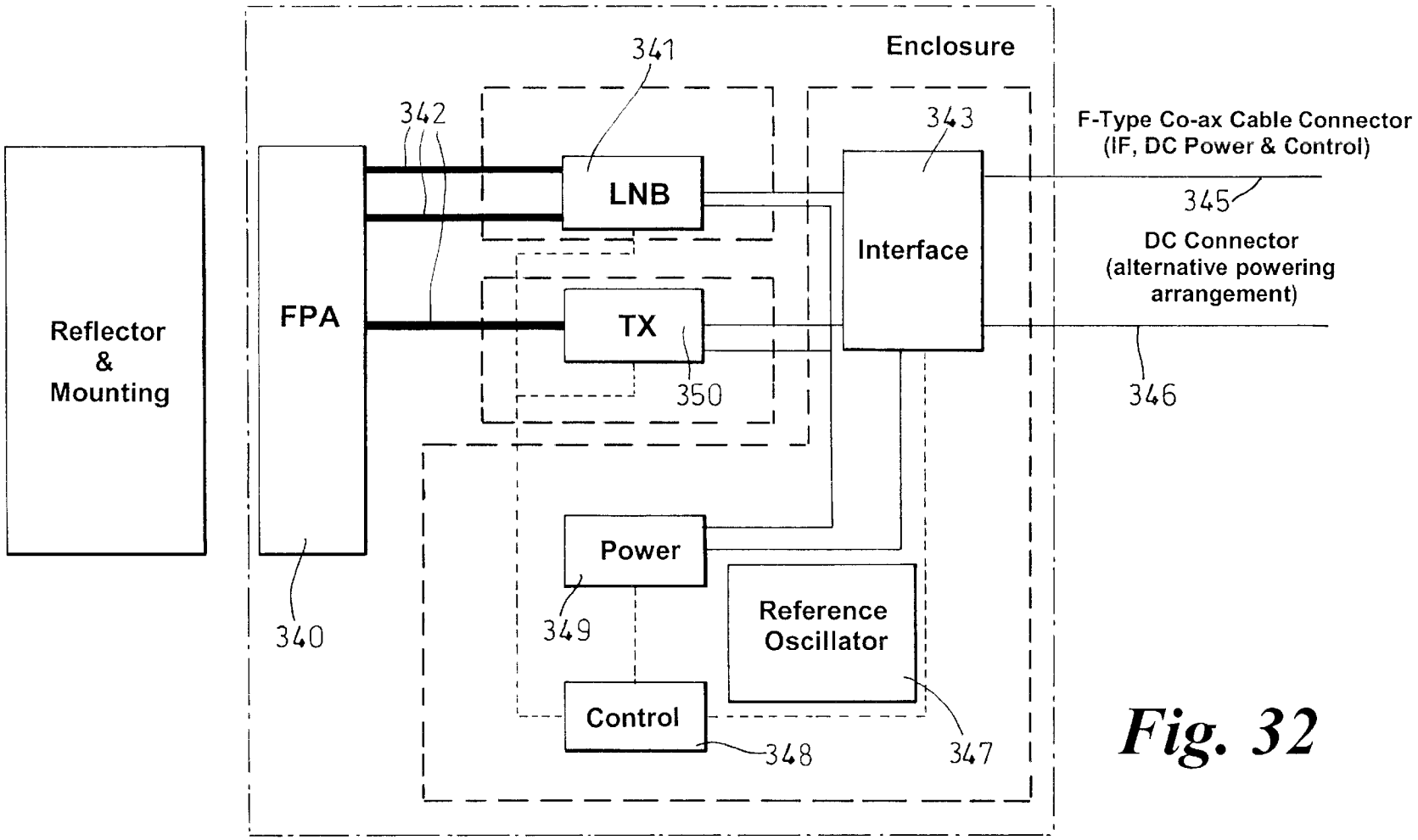
FIG. 32 is a block diagram of the components of a dual band antenna.
Figure 33:
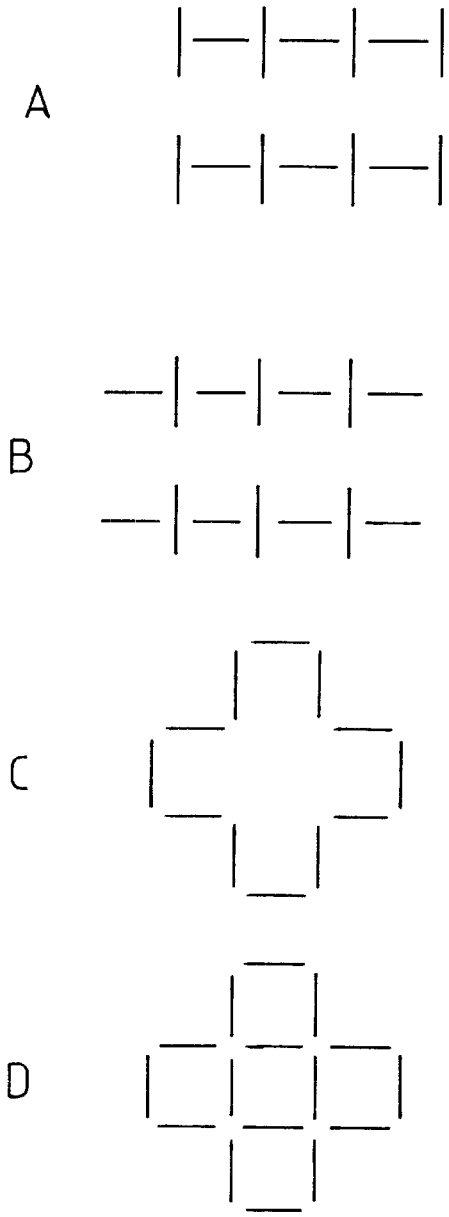
FIG. 33 shows possible configurations of slots in punched plates for use in feeds for reflector antennas.

FIG. 32 is a block diagram of the components of a dual band antenna and is applicable to the flat plate array embodiments, the flat plate array feed embodiments and the combined horn and flat plate array embodiments discussed above. Although FIG. 32 includes a block labelled "reflector and mounting", this block is not essential.

A flat plate array block 340 is shown and this represents either a flat plate array or a flat plate array and horn combination as described above. The flat plate array block 340 is connected to a low noise block 341 by two waveguides 342, one for horizontally polarised signals and one for vertically polarised signals. The low noise block is used as known in the art, to convert the amplitude of the signals received by the flat plate array block 340 in order to make these signals suitable for input to a subscriber indoor unit. The low noise block 341 is located towards the front of the assembly, near the flat plate array block 340, in order to reduce signal losses.

The low noise block 341 is in turn connected to an interface 343 which further converts the signals from the flat plate array block 340 in order to make these compatible with a subscriber's indoor unit, such as a TV receiver. Output from the interface to the subscriber's indoor unit is via a cable 345, for example, an F-type, coaxial cable connector. The interface 343 also has a connection 346 to a power supply, for example this may be a DC connector.

The assembly also contains a reference oscillator 347, a control unit 348 and a power unit 349 which are conventional units used as is known in the art.

The interface 343 also has another output which connects to a transmitter unit 350 which in turn is connected to the flat plate array block 340. In the case that a subscriber wishes to transmit a signal, for example, to request a web page or to request a particular television programme, the subscriber makes an input to the indoor unit. For example, this may be done using a remote control unit for a television set, which sends information about the user input via a set-top box and connection 345 to the interface 343. The user input is sent to the transmit unit 350 and converted into the appropriate type of signal before being transmitted using the flat plate array block 340. The transmitted signal is received by a satellite communication or other type of communication system.

In the event that signals are receive at the flat plate array block 340, for example, from a satellite communication system, these signals are processed by the low noise block 341, interface 343 and other units in the assembly before being passed to the subscriber's indoor unit via cable 345.

A range of applications are within the scope of the invention. These include situations in which it is required o form a dual band flat plate array antenna or a dual band flat plate array feed for a reflector antenna. These antennas and feeds may be used for two-way satellite communication such as interactive television. The range of applications also includes terrestrial communication systems and any application where it is required to provide dual band communication for example, two-way satellite communication.

We claim:

1. A dual band flat plate antenna comprising:

(i) a first flat plate array of first single band antenna elements operable at a first frequency band, said first plate array comprising regions between said first single band antenna elements;

(ii) a second flat plate array of second single band antenna elements operable at a second frequency band different from the first frequency band, said second flat plate array being positioned over said first flat plate array such that said second single band antenna elements overlie said regions of said first plate array; wherein both the first and second flat plate arrays each comprise a distribution network layer comprising a plurality of probes co-planar with the distribution network layer; said distribution network layer being positioned under and spaced apart from a plate of electrically conducting material comprising a plurality of apertures positioned such that each aperture is above a probe; and wherein (iii) one or more of said regions in said second flat plate array are removed by at least removing parts of the plate of electrically conducting material within that second flat plate array, such that in use, said first single band antenna elements are operable through said second flat plate array.

2. The antenna as claimed in claim 1 wherein said first single band antenna elements are arranged to receive signals and said second single band antenna elements are arranged to transmit signals.

3. The antenna as claimed in claim 1 wherein said first single band antenna elements are operable in the Ku frequency band and said second single band antenna elements are operable in the Ka frequency band.

4. The antenna as claimed in claim 1 wherein the ratio of said first and second frequency bands is approximately 2:5.

5. The antenna as claimed in claim 1 which further comprises a third flat plate array of third single band antenna elements positioned between said first and second flat plate arrays.

6. The antenna as claimed in claim 5 wherein said third single band antenna elements are operable at the same frequency as the first single band antenna elements.

7. The antenna as claimed in claim 5 wherein said first and third single band antenna elements are arranged to operate for signals of different polarities.

8. A dual band flat-plate array feed for a reflector antenna said array feed comprising:

(i) a first flat plate array of first single band antenna elements arranged to operate at a first frequency band said first flat plate array comprising regions between said first single band antenna elements;

(ii) a second flat plate array of second single band antenna elements arranged to operate at a second frequency band, said second flat plate array being positioned over said first flat plate array such that said second single band antenna elements overlie said regions of said first flat plate array;

wherein both the first and second flat plate arrays each comprise a distribution network layer comprising a plurality of probes co-planar with the distribution network layer; said distribution network layer being positioned under and spaced apart from a plate of electrically conducting material comprising a plurality of apertures positioned such that each aperture is above a probe; and wherein (iii) one or more regions in said second flat plate array are removed by at least removing parts of the plate of electrically conducting material within that second flat-plate array, such that in use, said first single band antenna elements are operable through said second flat plate array.

9. The feed as claimed in claim 8 wherein said second flat plate array further comprises a plurality of single band antenna elements arranged to operate at the same frequency band as said first single band antenna elements and with a different polarisation to said first single band antenna elements.

10. The feed as claimed in claim 8 which further comprises a third flat plate array of third single band antenna elements arranged to operate at the same frequency band as said first antenna elements and with a different polarisation to said first antenna elements.

11. The feed as claimed in claim 8 wherein the geometric arrangement of said first single band antenna elements and said second single band antenna elements is such that in use a receive and a transmit antenna beam are provided with approximately equal beamwidths and approximately equal phase centres.

12. The feed as claimed in claim 8 wherein the ratio of said first and second frequency bands is approximately 2:5.

13. A reflector antenna comprising a dual band flat-plate array feed, said flat-plate array feed comprising:

(i) a first flat plate array of first single band antenna elements arranged to operate at a first frequency band said first flat plate array comprising regions between said first single band antenna elements;

(ii) a second flat plate array of second single band antenna elements arranged to operate at a second frequency band different from the first frequency band, said second flat plate array being positioned over said first flat plate array such that said second single band antenna elements overlie said regions of said first flat plate array;

wherein both the first and second flat plate arrays each comprise a distribution network layer comprising a plurality of probes co-planar with the distribution network layer; said distribution network layer being positioned under and spaced apart from a plate of electrically conducting material comprising a plurality of apertures positioned such that each aperture is above a probe; and wherein (iii) one or more regions in said second flat plate array are removed by at least removing parts of the plate of electrically conducting material within that second flat-plate array, such that in use, said first single band antenna elements are operable through said second flat plate array.

14. A method of operating a dual band flat plate array antenna as claimed in claim 1 said method comprising the steps of:

(i) transmitting information input by a user to a satellite using said second single band antenna elements; and (ii) receiving signals from said satellite using said first single band antenna elements, on the basis of said transmitted information.

15. A method of operating a reflector antenna as claimed in claim 13 said method comprising the steps of:

(i) transmitting information input by a user to a satellite using said second single band antenna elements; and (ii) receiving signals from said satellite using said first single band antenna elements, on the basis of said transmitted information.

* * * * *